US008194009B2

(12) United States Patent
Iwabuchi

(10) Patent No.: US 8,194,009 B2
(45) Date of Patent: Jun. 5, 2012

(54) LIGHT EMITTING DEVICE AND DRIVING METHOD THEREOF

(75) Inventor: Tomoyuki Iwabuchi, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 840 days.

(21) Appl. No.: 11/132,030

(22) Filed: May 18, 2005

(65) Prior Publication Data

US 2005/0259053 A1 Nov. 24, 2005

(30) Foreign Application Priority Data

May 21, 2004 (JP) ..... 2004-151134

(51) Int. Cl.
*G09G 3/30* (2006.01)

(52) U.S. Cl. ..... 345/77; 345/82; 345/204; 345/690

(58) Field of Classification Search ..... 345/6–840; 315/169.3; 313/463
See application file for complete search history.

(56) References Cited

U.S. PATENT DOCUMENTS

| | | | | |
|---|---|---|---|---|
| 5,767,828 | A * | 6/1998 | McKnight | 345/89 |
| 5,990,629 | A | 11/1999 | Yamada et al. | |
| 6,587,086 | B1 | 7/2003 | Koyama | |
| 6,753,854 | B1 | 6/2004 | Koyama et al. | 345/204 |
| 6,952,194 | B1 | 10/2005 | Yamazaki et al. | |
| 7,145,536 | B1 | 12/2006 | Yamazaki et al. | |
| 7,239,083 | B2 | 7/2007 | Koyama | |
| 7,330,162 | B2 | 2/2008 | Yamazaki et al. | |
| 7,605,786 | B2 | 10/2009 | Yamazaki et al. | |
| 7,773,066 | B2 | 8/2010 | Yamazaki et al. | |
| 7,986,094 | B2 | 7/2011 | Koyama | |
| 2002/0021267 | A1 * | 2/2002 | Walker et al. | 345/76 |
| 2002/0149556 | A1 * | 10/2002 | Matsueda | 345/98 |
| 2003/0025656 | A1 | 2/2003 | Koyama et al. | 345/82 |
| 2003/0160743 | A1 * | 8/2003 | Yasuda | 345/76 |
| 2003/0197664 | A1 | 10/2003 | Koyama | 345/76 |
| 2003/0214465 | A1 * | 11/2003 | Kimura | 345/76 |
| 2004/0125422 | A1 * | 7/2004 | Wang et al. | 358/519 |

(Continued)

FOREIGN PATENT DOCUMENTS

| | | |
|---|---|---|
| JP | 8-234697 | 9/1996 |

(Continued)

OTHER PUBLICATIONS

U.S. Appl. No. 09/522,428, filed Mar. 9, 2000 including the specification, drawings and pending claims.

(Continued)

*Primary Examiner* — Lun-Yi Lao
*Assistant Examiner* — Insa Sadio
(74) *Attorney, Agent, or Firm* — Husch Blackwell LLP

(57) ABSTRACT

A light emitting device capable of suppressing generation of pseudo-contours by increasing the frame frequency while suppressing the drive frequency of a driver circuit is provided. According to the present invention, gray scales are displayed not only by controlling the emission period of a light emitting element, but also by controlling the luminance of the light emitting element. Specifically, one frame period is divided into a plurality of sub-frame periods each having an equal length, and the luminance of the light emitting element in each sub-frame period is controlled to have different levels. By controlling the total sum of the luminance level of the sub-frame periods that are selected with a video signal, a desired gray scale can be displayed.

10 Claims, 12 Drawing Sheets

U.S. PATENT DOCUMENTS

| | | | |
|---|---|---|---|
| 2005/0052392 | A1 | 3/2005 | Yamazaki et al. |
| 2005/0083287 | A1 | 4/2005 | Yamazaki et al. |
| 2007/0200809 | A1 | 8/2007 | Yamazaki et al. |
| 2011/0278572 | A1 | 11/2011 | Koyama |

FOREIGN PATENT DOCUMENTS

| | | |
|---|---|---|
| JP | 10-232649 | 9/1998 |
| JP | 2003-323157 | 11/2003 |
| WO | WO 98/33165 A1 | 7/1998 |

OTHER PUBLICATIONS

U.S. Appl. No. 09/534,812, filed Mar. 24, 2000 including the specification, drawings and pending claims.

* cited by examiner

LIGHT EMITTING DEVICE AND DRIVING METHOD THEREOF

BACKGROUND OF THE INVENTION

1. Field of the Invention

The present invention relates to a light emitting device capable of displaying gray scales using a time gray scale method, and a driving method thereof.

2. Description of the Related Art

As a known light emitting device, there is a light emitting device that is driven with an analog video signal, or a light emitting device that is driven with a digital video signal. In the case of using an analog video signal, gray scales can be displayed by controlling the luminance of a light emitting element with the analog video signal. Specifically, by controlling a gate-source voltage Vgs (gate voltage) of a TFT connected in series with the light emitting element using an analog video signal, a drain current value of the TFT that is supplied to the light emitting element, namely the luminance of the light emitting element is controlled.

However, in the case of the driving method using an analog video signal, the lower the level of the displayed gray scale is, the smaller the difference between the gate voltage Vgs and the threshold voltage Vth is required to be. In addition, a drain current of a TFT operating in the saturation region is proportional to the square of the difference between the gate voltage Vgs and the threshold voltage Vth. Accordingly, there has been a problem that a drain current is easily affected by variations of the threshold voltage Vth when adopting the driving method using an analog video signal.

Meanwhile, in the case of the driving method using a digital video signal, the gate voltage Vgs can be maintained constant, therefore, the difference between the gate voltage Vgs and the threshold voltage Vth can be set large. Accordingly, when displaying a low-level gray scale, a drain current is less easily affected by variations of the threshold voltage Vth than the case of using an analog video signal.

As one of the driving methods using a digital video signal, there is a time gray scale method by which gray scales are displayed by controlling emission periods of light emitting elements in pixels within one frame. Specifically, when displaying an image using the time gray scale method, one frame period is divided into a plurality of sub-frame periods. Pixels are controlled to emit light or no light in each sub-frame period in accordance with a video signal. With such a structure, the total length of the actual emission periods of light emitting elements in pixels within one frame can be controlled with a video signal, thereby gray scales can be displayed.

In the case of displaying an image using the time gray scale method, however, there is a problem that pseudo-contours are displayed in the pixel portion depending on the frame frequency. The pseudo-contours are unnatural contour lines that are often perceived when a middle-level gray scale is displayed using a time gray scale method, which are supposedly caused by a changing perception of luminance as a peculiar characteristic of the human vision.

The pseudo-contours include a moving-image pseudo-contour that is generated when displaying a moving image, and a still-image pseudo-contour that is generated when displaying a still image. The moving-image pseudo-contour is generated when a sub-frame period included in a certain frame period, and a sub-frame period included in the subsequent frame period are perceived as one continuous frame period by human eyes. That is, the moving-image pseudo-contour corresponds to an unnatural bright line or dark line that is displayed in the pixel portion when a gray scale, which has deviated from the desired gray scale to be displayed in a certain frame period, is perceived by human eyes. The generation mechanism of the still-image pseudo-contour is similar to that of the moving-image pseudo-contour. The still-image pseudo-contour is generated when displaying a still image, in which a visual point of humans slightly moves vertically or horizontally on the boundary between the regions where gray scales of different levels are displayed, which causes the still image to appear just as if a moving image is displayed in the pixels in the vicinity of the boundary. That is, the still-image pseudo-contour corresponds to an unnatural bright line or dark line that is displayed in a swaying manner in the pixels in the vicinity of the boundary between the regions where gray scales of different levels are displayed, which is caused by generation of the moving-image pseudo-contour.

In order to prevent generation of the aforementioned pseudo-contours, it is effective to increase the frame frequency. However, when the frame frequency is increased extremely higher, the length of each sub-frame period becomes shorter. Accordingly, the drive frequency of a driver circuit is required to be increased in accordance with the length of the shortest sub-frame period. Thus, it is not very preferable to increase the frame frequency when considering the reliability of the driver circuit.

SUMMARY OF THE INVENTION

In view of the foregoing problems, it is an object of the present invention to provide a light emitting device capable of suppressing generation of pseudo-contours by increasing the frame frequency while suppressing the drive frequency of a driver circuit. It is another object of the present invention to provide a driving method of a light emitting device capable of suppressing generation of pseudo-contours by increasing the frame frequency while suppressing the drive frequency of a driver circuit.

According to the present invention, gray scales are displayed not only by controlling the emission period of a light emitting element, but also by controlling the luminance of the light emitting element. Specifically, one frame period is divided into a plurality of sub-frame periods each having an equal length, and the luminance of the light emitting element in each sub-frame period is controlled to have different levels. By controlling the total sum of the luminance level of the sub-frame periods that are selected with a video signal, a desired gray scale can be displayed.

Note that the luminance of a light emitting element can be controlled by operating a transistor for controlling a current supplied to the light emitting element (driving transistor) in the saturation region, and switching a value of the gate voltage Vgs of the transistor. Accordingly, the light emitting device of the present invention comprises a pixel portion having pixels, and a selection circuit for inputting a second video signal that is generated by selecting, based on data included in each bit of a first video signal, one of a first power source voltage that can be switched in synchronization with a sub-frame period corresponding to the bit, and a second power source voltage having a constant level. Further, the light emitting device of the present invention may comprise a scan line driver circuit for selecting pixels, and a signal line driver circuit for parallel-serial converting the first video signal.

With respect to the luminance level of the light emitting element in each sub-frame period, the luminance level of the light emitting element in sub-frame periods other than the sub-frame period having the lowest luminance is controlled to be $2^{(n-1)}$ times as high as that in the sub-frame period having the lowest luminance. Note that the luminance level of the light emitting element in the sub-frame period corresponding to (n+1) bit is controlled to be 2 times as high as that in the sub-frame period corresponding to n bit. Here, "n" is a natural number not less than 1. Note that the light emitting device of the present invention is not limited to this, the luminance levels of the light emitting element in the sub-frame period corresponding to each bit are only required to be at least partly different from each other. Accordingly, a value of the gate voltage Vgs of the driving transistor is also required to be controlled so that the aforementioned luminance is obtained in each sub-frame period.

Light emitting element in this specification includes an element the luminance of which is controlled with current or voltage, specifically such as an OLED (Organic Light Emitting Diode), an MIM-type electron source element (electron-emissive element) used for an FED (Field Emission Display) and the like.

OLED (Organic Light Emitting Diode) that is one of the light emitting elements comprises an anode, a cathode and a layer containing electroluminescent materials that can generate luminescence (electroluminescence) when an electronic field is applied thereto (hereinafter referred to as an electroluminescent layer). The electroluminescent layer is sandwiched between the anode and the cathode, and includes a single or a plurality of layers. These layers may contain inorganic compounds. The luminescence generated in the electroluminescent layer includes luminescence that is generated when an excited singlet state returns to a ground state (fluorescence) and luminescence that is generated when an exited triplet state returns to a ground state (phosphorescence).

In this specification, one of the anode and the cathode, a potential of which can be controlled with a driving transistor, is referred to as a first electrode while the other is referred to as a second electrode.

The light emitting device includes a panel in the condition that light emitting elements are sealed, and a module in the condition that an IC or the like including a controller is mounted over the panel. Further, the present invention relates to an element substrate that corresponds to a mode where light emitting elements are not yet completed in the manufacturing steps of the light emitting device. The element substrate comprises a means for supplying current to a light emitting element in each of a plurality of pixels.

The element substrate corresponds to a mode where light emitting elements are not yet completed in the manufacturing steps of the light emitting device of the present invention. Specifically, the element substrate may be in the condition that only a first electrode of the light emitting element is formed, the condition that a conductive film to be a first electrode is deposited but not yet patterned to be completed, or various other conditions.

Note that a transistor used in a light emitting device of the present invention may be a thin film transistor formed of a polycrystalline semiconductor, a microcrystalline semiconductor (including a semi-amorphous semiconductor), or an amorphous semiconductor, however, the present invention is not limited to these. It may be a transistor formed by using single crystalline silicon or SOI. Alternatively, it may be a transistor formed by using an organic semiconductor or carbon nanotube. In addition, a transistor disposed in each pixel of the light emitting device of the present invention may have a single-gate structure, a double-gate structure, or a multi-gate structure having more than two gates.

Semi-amorphous semiconductor has an intermediate structure between amorphous and crystalline (including single crystalline and polycrystalline) structures. The semi-amorphous semiconductor is a semiconductor having a third state that is stable in free energy, and includes a crystalline region having a short-range order and lattice distortion. The semi-amorphous semiconductor having a crystalline grain of 0.5 to 20 nm can be dispersed into an amorphous semiconductor. In addition, it has the characteristic that Raman spectrum is shifted to the lower frequency than 520 $cm^{-1}$, and has the observed diffraction peaks at (111) and (220) by the X-ray diffraction that is supposedly caused by the Si-crystal lattices. In addition, it contains hydrogen or halogen with a concentration of 1 or more atomic % in order to terminate dangling bonds. Such a semiconductor is called a semi-amorphous semiconductor (SAS) here for convenience. Further, a stable and superior semi-amorphous semiconductor can be obtained when the lattice distortion is further promoted by adding noble gas elements such as helium, argon, krypton and neon.

Conventionally, gray scales have been displayed by controlling the emission period of a light emitting element, therefore, the length of the shortest sub-frame period among n sub-frame periods is $1/2^{n-1}$ times as long as the longest sub-frame period ("n" is a natural number not less than 1). However, according to the present invention having the aforementioned structure, each sub-frame period can be controlled to have an equal length. Therefore, it can be prevented, unlike the conventional techniques, that each sub-frame period becomes short even when the frame frequency is increased. Thus, generation of pseudo-contours can be suppressed by increasing the frame frequency while suppressing a drive frequency of a driver circuit.

DETAILED DESCRIPTION OF THE PREFERRED EMBODIMENTS

Although the present invention will be fully described by way of embodiment mode and embodiments with reference to the accompanying drawings, it is to be understood that various changes and modifications will be apparent to those skilled in the art. Therefore, unless such changes and modifications depart from the scope of the present invention, they should be construed as being included therein.

Figure 1:
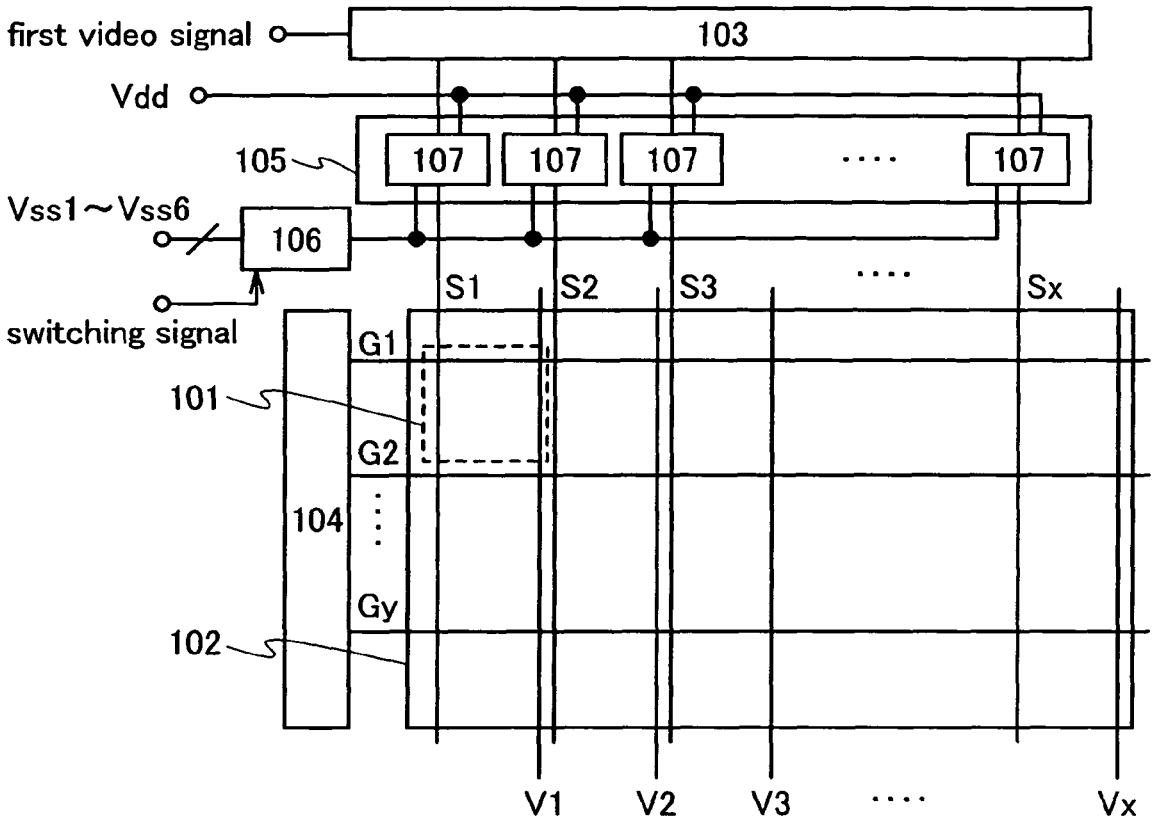
FIG. 1 is a diagram illustrating a configuration of a light emitting device of the present invention.

FIG. 1 illustrates a configuration of the light emitting device of the present invention. The light emitting device of the present invention shown in FIG. 1 comprises a pixel portion 102 including a plurality of pixels 101, a signal line driver circuit 103, a scan line driver circuit 104, a selection circuit group 105 and a voltage-setting circuit 106. The selection circuit group 105 includes a plurality of selection circuits 107. Each pixel 101 is supplied with various voltage signals or power source voltages from signal lines S1 to Sx, scan lines G1 to Gy, and power source lines V1 to Vx. Here, each of "x" and "y" is a natural number not less than 2.

Note that FIG. 1 illustrates a configuration of a light emitting device using the signal lines S1 to Sx, the scan lines G1 to Gy, and the power source lines V1 to Vy, however, the present invention is not limited to such a configuration. The kind and number of wirings for supplying various voltage signals or power source voltages to each pixel 101 are not limited to the ones shown in FIG. 1, and they may be changed appropriately in accordance with the configuration of the pixel 101.

Figure 2A:
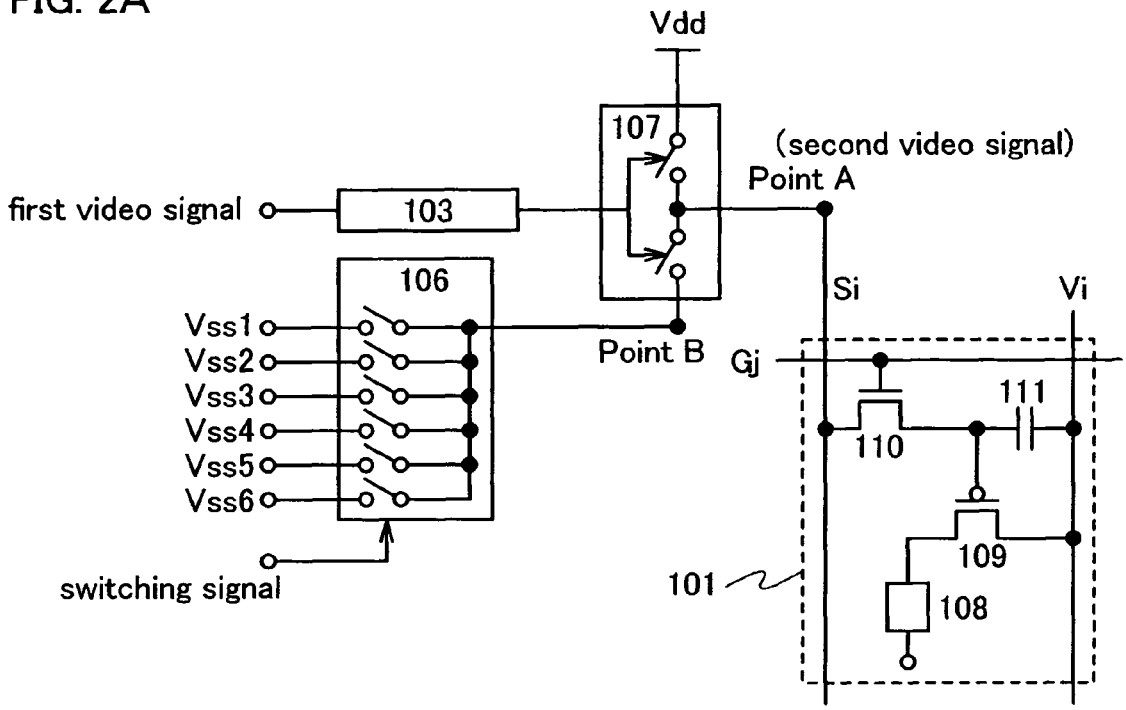
FIGS. 2A to 2C are diagrams illustrating the detailed configurations of the light emitting device shown in FIG. 1.

FIG. 2A illustrates a specific configuration of the voltage-setting circuit 106, the selection circuit 107 and the pixel 101 included in the light emitting device shown in FIG. 1. Note that FIG. 2A only illustrates one pixel 101 included in the pixel portion 102, and one selection circuit 107 corresponding to the pixel 101 as a representative example.

The signal line driver circuit 103 parallel-serial converts an inputted first video signal which is then inputted to each of the plurality of selection circuits 107 included in the selection circuit group 105 of the subsequent stage. The voltage-setting circuit 106 selects a voltage corresponding to each sub-frame period in synchronization with a selection signal, which is then supplied to each of the plurality of selection circuits 107 included in the selection circuit group 105 of the subsequent stage. That is, the selection signal is a signal synchronous with each sub-frame period.

Note that FIG. 1 and FIG. 2A illustrate the case where gray scales are displayed using 6 sub-frame periods. Accordingly, in FIG. 1 and FIG. 2A, one of voltages Vss1 to Vss6 is selected by the voltage-setting circuit 106, which is supplied to each of the plurality of selection circuits 107.

Also, each selection circuit 107 is supplied with a voltage Vdd that is higher than the voltages Vss1 to Vss6 supplied from the voltage-setting circuit 106. Note that FIG. 1 illustrates the case where a driving transistor 109, which controls a current supply to a light emitting element 108 included in the pixel 101, is a P-channel transistor. In the case where the driving transistor 109 is an N-channel transistor, one of voltages Vdd1 to Vdd6 selected by the voltage-setting circuit 106 instead of the voltages Vss1 to Vss6, and the voltage Vss that is lower than the voltages Vdd1 to Vdd6 are supplied to each of the plurality of selection circuits 107.

The selection circuit 107 supplies to a signal line Si (1=i=x) connected to the corresponding pixel 101, one of the voltages Vss1 to Vss6, and the voltage Vdd as a second video signal in accordance with the first signal inputted from the signal line driver circuit 103.

Figure 2B:
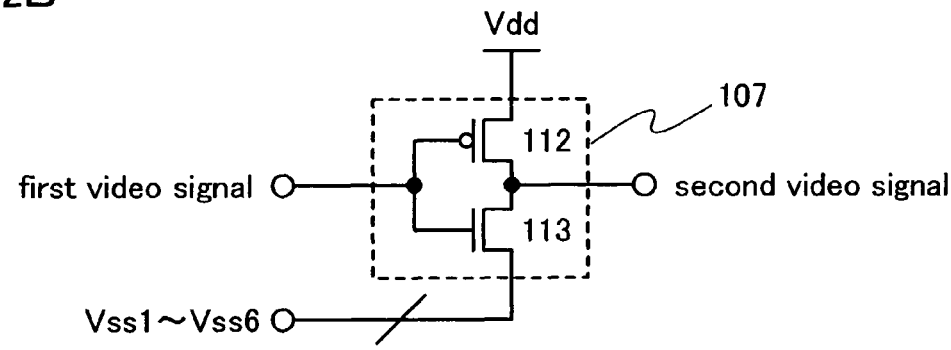

Note that the selection circuit 107 may be a circuit capable of selecting one of the voltages Vss1 to Vss6, and the voltage Vdd in accordance with the first video signal inputted from the signal line driver circuit 103. FIG. 2B illustrates the case where an inverter is used for the selection circuit 107.

Specifically, the selection circuit 107 shown in FIG. 2B includes a P-channel transistor 112 and an N-channel transistor 113. Gates of the P-channel transistor 112 and the N-channel transistor 113 are connected to each other, and drains thereof are also connected to each other. The voltage Vdd is supplied to a source of the P-channel transistor 112, and one of the voltages Vss1 to Vss6 is supplied to a source of the N-channel transistor 113.

A voltage of the first video signal is supplied to the gates of the P-channel transistor 112 and the N-channel transistor 113. In addition, voltages of the drains of the P-channel transistor 112 and the N-channel transistor 113 are supplied to the signal line Si as the second video signal.

Figure 2C:
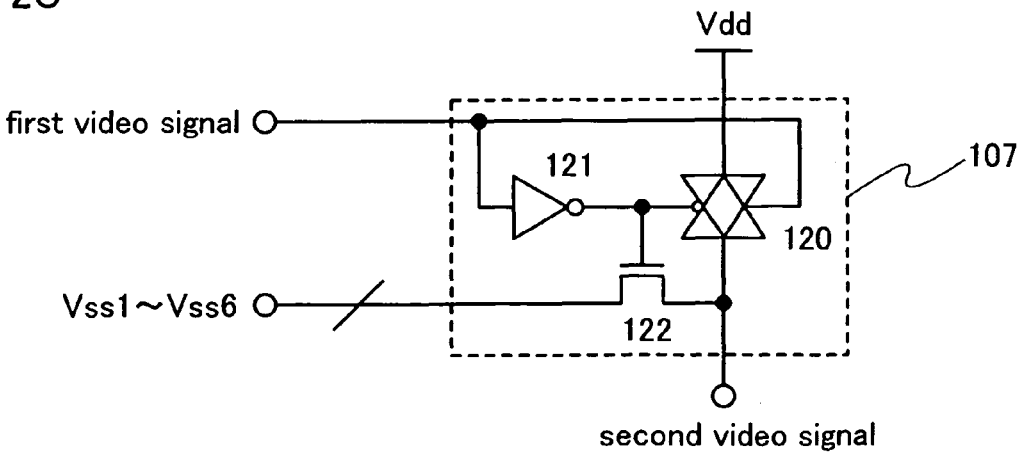

Note that the selection circuit 107 is not limited to the configuration shown in FIG. 2B. FIG. 2C illustrates an example where a transmission gate is used as the selection circuit 107.

The selection circuit 107 shown in FIG. 2C includes a transmission gate 120, an inverter 121 and a transistor 122. A first video signal is inputted to a second control terminal of the transmission gate 120, and an input terminal of the inverter 121. An output terminal of the inverter 121 is connected to a first control terminal of the transmission gate 120 and a gate of the transistor 122. The voltage Vdd is supplied to an input terminal of the transmission gate 120. One of a source and a drain of the transistor 122 is supplied with one of the voltages Vss1 to Vss6, and the other is connected to an output terminal of the transmission gate 120. A voltage of the output terminal of the transmission gate 120 is supplied to the signal line Si as the second video signal.

Note that switching of the transmission gate 120 is controlled in accordance with the voltage of the signal inputted to the first control terminal and the second control terminal thereof. Specifically, the voltage of the input terminal can be supplied to the output terminal only when a low voltage and a high voltage are supplied to the first control terminal and the second control terminal, respectively.

The selection circuit 107 used in the present invention may be a circuit capable of selecting and outputting one of two voltages in accordance with a first video signal.

The voltage-setting circuit 114 used in the present invention may be a circuit capable of selecting and outputting one of Vss1 to Vss6 in accordance with a switching signal. For example, the voltage-setting circuit 114 may be a D/A converter circuit, a circuit comprising at least one power source, at least one resistant, at least one analog switch and at least one analog buffer, or a circuit comprising thin film transistors.

The pixel 101 shown in FIG. 2A includes a transistor (switching transistor) 110 for controlling a video signal input to the pixel 101, the driving transistor 109, the light emitting element 108, and a capacitor 111 for storing a gate voltage of the driving transistor 109. Note that the capacitor 111 is not necessarily provided.

Specifically, a gate of the switching transistor 110 is connected to a scan lien Gj (1=j=y). One of a source and a drain of the switching transistor 110 is connected to the signal line Si, and the other is connected to a gate of the driving transistor 109. The light emitting element 108 includes a first electrode, a second electrode and an electroluminescent layer sandwiched between them. One of a source and a drain of the driving transistor 109 is connected to a power source line Vi (1=i=x) while the other is connected to the first electrode of the light emitting element 108.

Note that each of the first electrode and the second electrode of the light emitting element 108 may be either an anode or a cathode. However, in the case where the driving transistor 109 is a P-channel transistor, it is desirable that the first electrode thereof be an anode while the second electrode thereof be a cathode, which allows the gate voltage of the driving transistor 109 to be stabilized. In the case where the driving transistor 109 is an N-channel transistor, on the other hand, it is desirable that the first electrode thereof be a cathode while the second electrode thereof be an anode, which allows the gate voltage of the driving transistor 109 to be stabilized.

One of two electrodes of the capacitor 111 is connected to the gate of the driving transistor 109 while the other is connected to the power source line Vi.

Note that the light emitting device of the present invention is not limited to the configuration of the pixel 101 shown in FIG. 2A. In the pixel 101 included in the light emitting device of the present invention, it is only required that a current supplied to the light emitting element 108 be controlled with the gate voltage of the driving transistor 109 while the gate voltage of the driving transistor 109 be controlled with the voltage of the second video signal.

Note that FIG. 2A illustrates the pixel 101 having a P-channel transistor as the driving transistor, in which case a voltage Ve that is equal to or lower than the voltage Vdd, and higher than the voltages Vss1 to Vss6 is supplied to the power source line Vi. In the case where the driving transistor is an N-channel transistor, on the other hand, a voltage Ve that is higher than the voltage Vss and lower than the voltages Vdd1 to Vdd6 is supplied to the power source line Vi.

When the switching transistor 110 is turned ON by controlling the voltage of the scan line Gj, a voltage of the signal line Si is supplied to the gate of the driving transistor 109. Accordingly, in the case where one of the voltages Vss1 to Vss6 is supplied to the signal line Si from the selection circuit 107, the gate voltage Vgs of the driving transistor 109 is equal to a value obtained by subtracting the voltage Ve of the power source line Vi from one of the voltages Vss1 to Vss6. Through the driving transistor 109, a drain current having a corresponding value to the gate voltage thereof flows, which is then supplied to the light emitting element 108. Accordingly, selection of one of the voltages Vss1 to Vss6 enables control of a drain current value of the driving transistor 109, namely the luminance of the light emitting element 108 that receives the drain current.

Meanwhile, in the case where the voltage Vdd is supplied to the signal line Si from the selection circuit 107, the gate voltage Vgs of the driving transistor 109 becomes equal to a value obtained by subtracting the voltage Ve of the power source line Vi from the voltage Vdd. Accordingly, the driving transistor 109 is turned OFF, thereby the light emitting element 108 does not emit light.

With respect to the luminance level of the light emitting element in each sub-frame period, the luminance level of the light emitting element in sub-frame periods other than the sub-frame period having the lowest luminance is controlled to be $2^{(n-1)}$ times as high as that in the sub-frame period having the lowest luminance. Note that the luminance level of the light emitting element in the sub-frame period corresponding to (n+1) bit is controlled to be 2 times as high as that in the sub-frame period corresponding to n bit. Note that the light emitting device of the present invention is not limited to this, the luminance levels of the light emitting element in the sub-frame period corresponding to each bit are only required to be at least partly different from each other. Accordingly, a value of the gate voltage Vgs of the driving transistor 109 is also required to be controlled so that the aforementioned luminance is obtained in each sub-frame period. A drain current I of a transistor operating in the saturation region satisfies the following Formula 1. Note that in Formula 1, $\beta=\mu C_0 W/L$ is satisfied under the condition that μ is mobility, $C_0$ is gate capacitance per unit area, W/L is a ratio of a channel width to a channel length of a channel formation region, and Vth is a threshold voltage.

$$I=\beta(Vgs-Vth)^2/2 \qquad \text{Formula 1}$$

Provided that the threshold voltage is 0, it is evident from Formula 1 that the drain current I is substantially proportional to the square of the gate voltage Vgs. The luminance of the light emitting element is proportional to the drain current I, therefore, in order to increase the luminance of the light emitting element $2^{n-1}$ times as high, the gate voltage Vgs of the driving transistor is required to be set as high as the square root of $2^{n-1}$.

Figure 3:
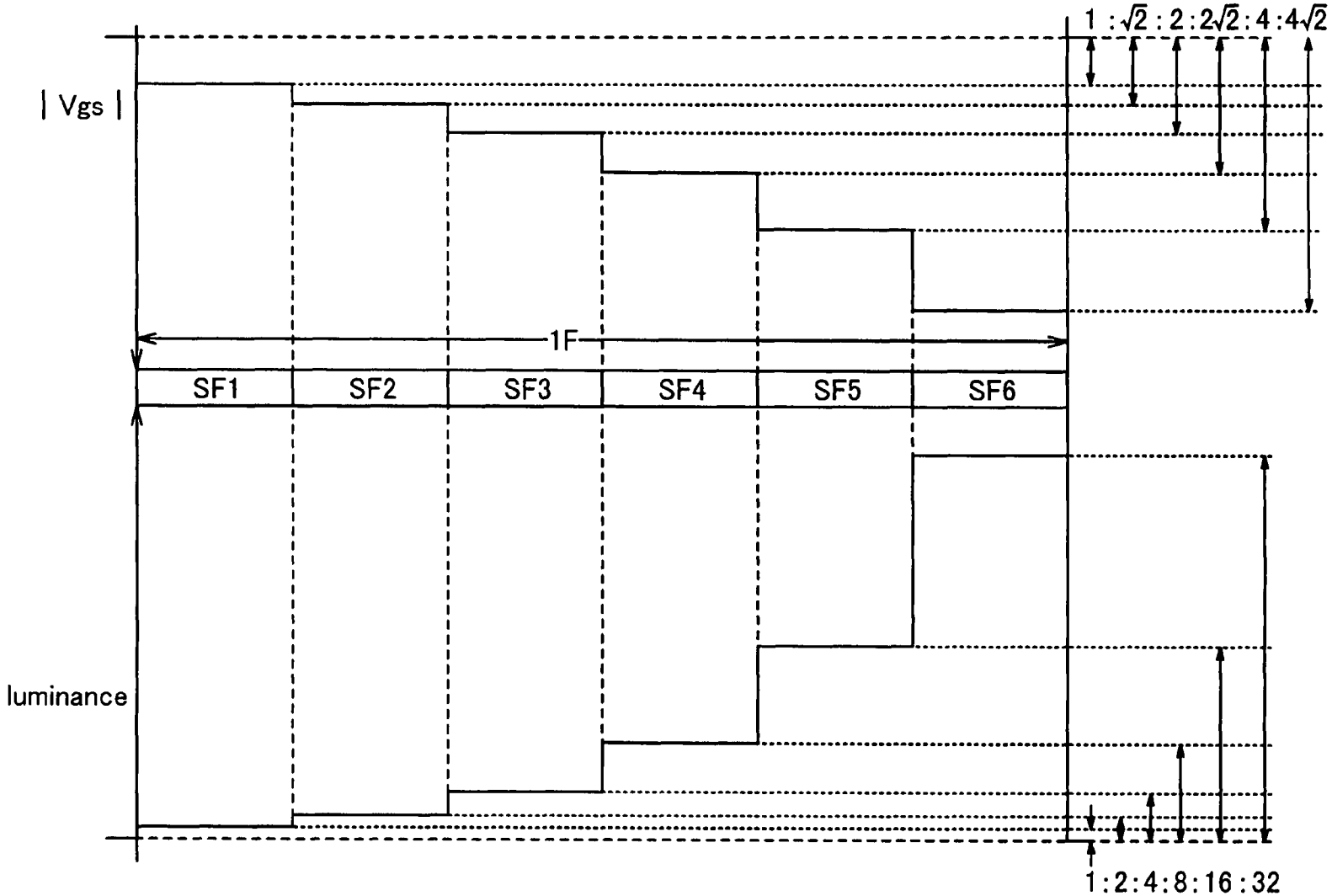
FIG. 3 is a diagram illustrating a relationship between the luminance of a light emitting element and a gate voltage Vgs of a driving transistor in each sub-frame period according to the invention.

FIG. 3 illustrates a relationship between the luminance of the light emitting element 108 and the gate voltage Vgs of the driving transistor 109 in each sub-frame period in the case of displaying gray scales of 64 using 6 sub-frame periods. FIG. 3 illustrates the case where the threshold voltage Vth is assumed to be 0. As shown in FIG. 3, when the ratio of the luminance of the light emitting element 108 in each sub-frame period is set to satisfy SF1:SF2:SF3:SF4:SF5:SF6=1:2:4:8:16:32, the ratio of the absolute value of the gate voltage Vgs of the driving transistor 109 in each sub-frame period is set to satisfy the following Formula 2.

$$SF1:SF2:SF3:SF4:SF5:SF6=1:\sqrt{2}:2:2\sqrt{2}:4:4\sqrt{2} \qquad \text{Formula 2}$$

With such a configuration, the total number of gray scales of 64 can be displayed within one frame period. Note that Formula 2 shows the ratio of the gate voltage Vgs in the case where the threshold voltage Vth is assumed to be 0, however in actuality, the ratio of the gate voltage Vgs of the driving transistor 109 is required to be determined in consideration of the threshold voltage Vth. That is, it is essential that |Vgs−Vth| satisfy Formula 2. In addition, in all the sub-frame periods, |Vgs−Vth| is set smaller than the drain-source voltage Vds.

Table 1 illustrates an example where the total number of gray scales of 16 is displayed using 4 sub-frame periods, which specifically shows the relationship between the emission/non-emission state and the number of gray scales in each sub-frame period. Note that Table 1 illustrates the emission state as ○ and the non-emission state as x. Note also that the ratio of the luminance in each frame period satisfies SF1:SF2:SF3:SF4=1:2:4:8.

TABLE 1

| | SF1 | SF2 | SF3 | SF4 |
|---|---|---|---|---|
| 1 | x | x | x | x |
| 2 | ○ | x | x | x |
| 3 | x | ○ | x | x |
| 4 | ○ | ○ | x | x |
| 5 | x | x | ○ | x |
| 6 | ○ | x | ○ | x |
| 7 | x | ○ | ○ | x |
| 8 | ○ | ○ | ○ | x |
| 9 | x | x | x | ○ |
| 10 | ○ | x | x | ○ |

TABLE 1-continued

| | SF1 | SF2 | SF3 | SF4 |
|---|---|---|---|---|
| 11 | x | ○ | x | ○ |
| 12 | ○ | ○ | x | ○ |
| 13 | x | x | ○ | ○ |
| 14 | ○ | x | ○ | ○ |
| 15 | x | ○ | ○ | ○ |
| 16 | ○ | ○ | ○ | ○ |

In addition, Table 2 illustrates an example where the total number of gray scales of 16 is displayed using 5 sub-frame periods, which specifically shows the relationship between the emission/non-emission state and the number of gray scales in each sub-frame period. Note that Table 2 illustrates the emission state as ○ and the non-emission state as x. Note also that the ratio of the luminance in each frame period satisfies SF1:SF2:SF3:SF4:SF5=1:2:3:5:7.

TABLE 2

| | SF1 | SF2 | SF3 | SF4 | SF5 |
|---|---|---|---|---|---|
| 1 | x | x | x | x | x |
| 2 | ○ | x | x | x | x |
| 3 | x | ○ | x | x | x |
| 4 | ○ | ○ | x | x | x |
| 5 | ○ | x | ○ | x | x |
| 6 | x | ○ | ○ | x | x |
| 7 | x | ○ | x | ○ | x |
| 8 | ○ | ○ | x | ○ | x |
| 9 | ○ | x | ○ | ○ | x |
| 10 | x | ○ | ○ | ○ | x |
| 11 | ○ | ○ | ○ | ○ | x |
| 12 | x | ○ | ○ | x | ○ |
| 13 | ○ | x | ○ | x | ○ |
| 14 | ○ | ○ | x | x | ○ |
| 15 | x | ○ | x | x | ○ |
| 16 | ○ | x | x | x | ○ |

However, the present invention is not limited to the total number of gray scales of 16 or 64 as illustrated above, and it can be applied to other numbers of gray scales.

Figure 4:
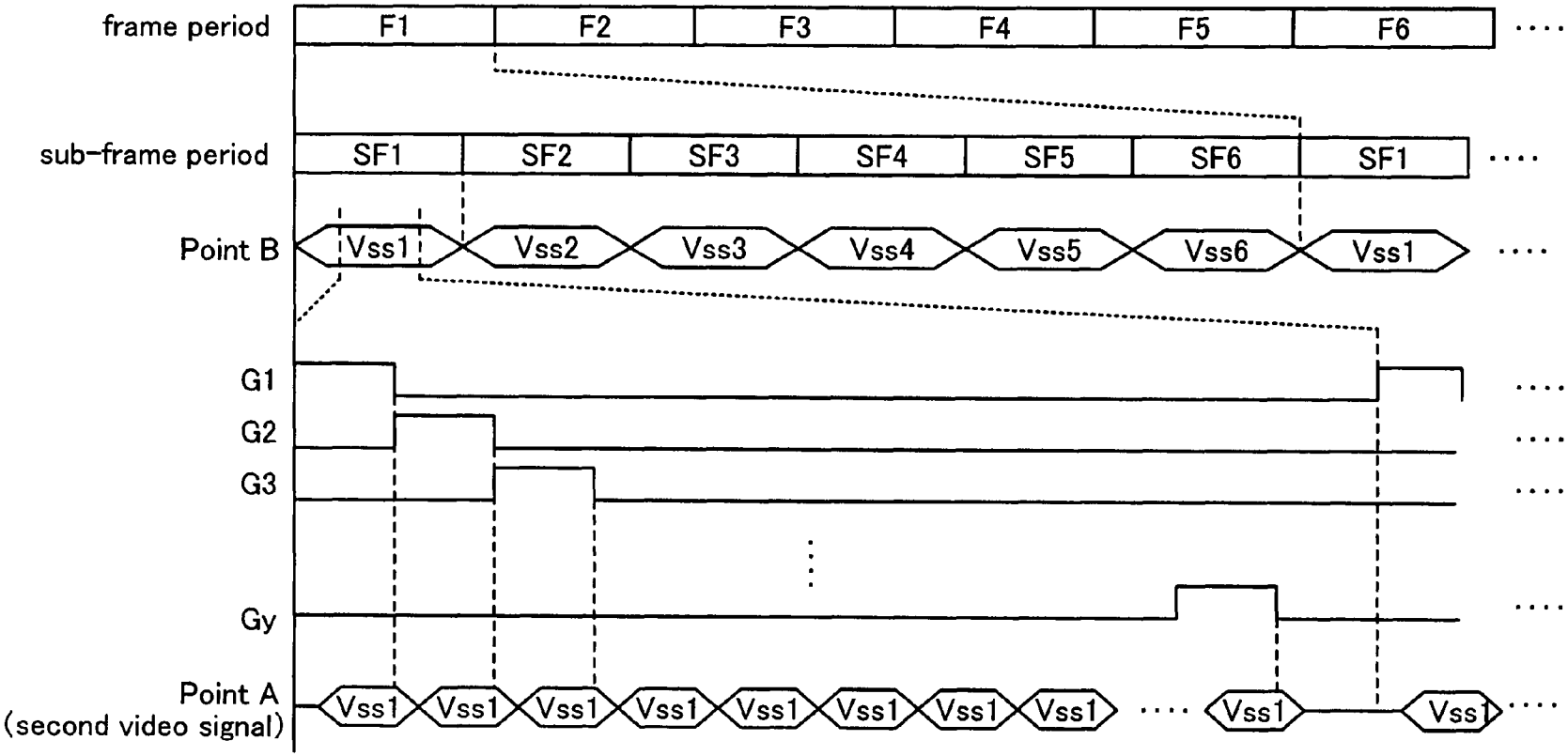
FIG. 4 is a timing chart of a pixel portion included in a light emitting device of the present invention.

Description is made below on the operation of the pixel portion 102 in each sub-frame period in the light emitting device shown in FIG. 1 and FIG. 2A. FIG. 4 illustrates a timing chart of the pixel portion 102 in the light emitting device shown in FIG. 1 and FIG. 2A. Note that FIG. 4 illustrates an example where the total number of gray scales of 64 is displayed using 6 sub-frame periods SF1 to SF6.

As shown in FIG. 4, each of a plurality of frame periods F1, F2, F3 . . . includes six sub-frame periods SF1 to SF6. Note that when displaying the total number of gray scales of $2^n$, each frame period is set to have n sub-frame periods.

A voltage selected by the voltage-setting circuit 106 is switched in synchronization with each sub-frame period in accordance with a switching signal. Accordingly, when 6 sub-frame periods are provided, a voltage of a point B at the output side of the voltage-setting circuit 106 is switched to one of the voltages Vss1 to Vss6 in synchronization with each sub-frame period as shown in FIG. 4.

In addition, in each sub-frame period, the scan lines G1 to Gy are sequentially selected. Specifically, each voltage of the scan lines G1 to Gy are sequentially controlled so that the switching transistor 110 is turned ON. In the period when each scan line G1 to Gy is selected, a voltage of the corresponding second video signal is supplied to the signal lines S1 to Sx in parallel or sequence. Note that FIG. 4 illustrates a timing chart in the case where the second video signal is inputted to the signal lines S1 to Sx in parallel when the number of gray scales of 64 is displayed in the whole pixels. Specifically, FIG. 4 illustrates a voltage of a point A at the input side of the signal line Si.

With such a configuration, the desired gray scales can be displayed in the whole pixels in the pixel portion.

Note that FIG. 1 and FIG. 2A illustrate the example where one of a plurality of voltages is selected in the voltage-setting circuit 106, and the selected voltage is supplied to the selection circuit 107 of the subsequent stage, however, the present invention is not limited to such a configuration. For example, a digital signal (voltage control signal) may be converted to an analog signal, and a voltage of the converted signal can be supplied to the selection circuit 107.

Figure 5:
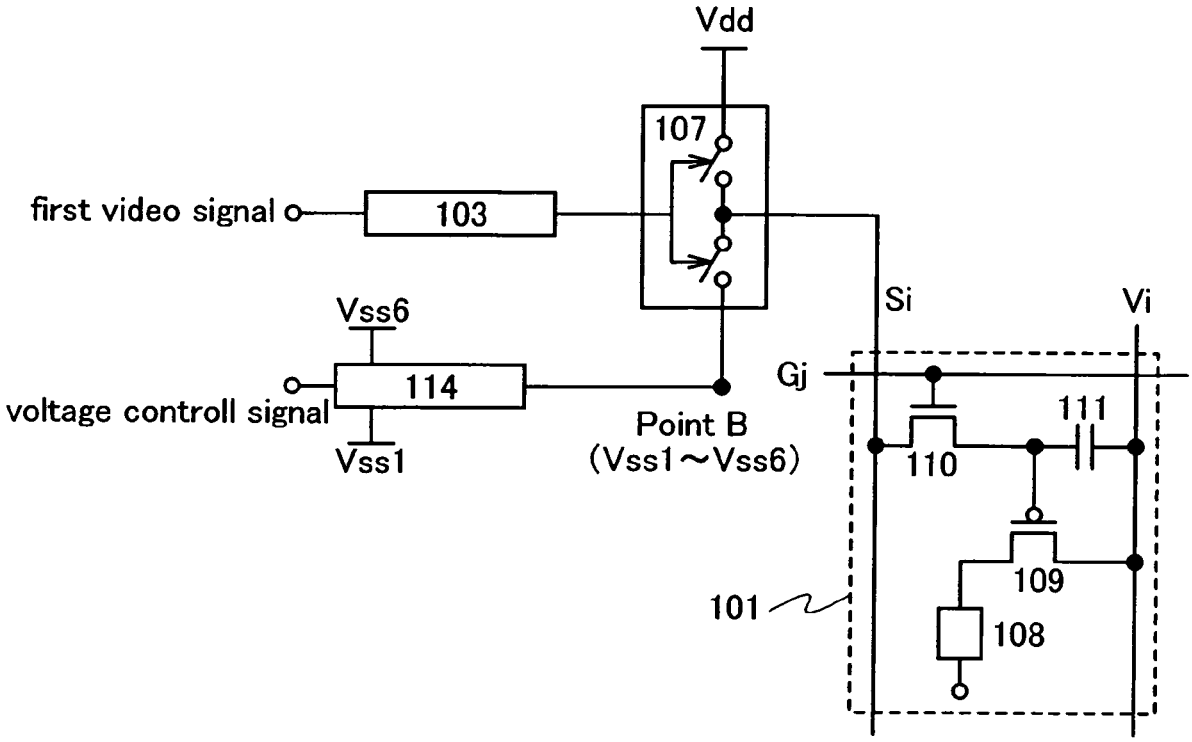
FIG. 5 is a diagram illustrating a light emitting device of the present invention in the case where a voltage supplied to a selection circuit is selected by using a digital voltage control signal.

FIG. 5 illustrates a configuration of a light emitting device in the case where a voltage supplied to the selection circuit 107 is selected by using a digital voltage control signal. Note that in FIG. 5, portions having common configurations to those in FIG. 2A are denoted by common reference numerals. The light emitting device shown in FIG. 5 is different from the light emitting device shown in FIG. 2A in the configuration of the voltage-setting circuit 114. The voltage-setting circuit 114 is supplied with two voltages of Vss1 and Vss6. The voltage control signal is synchronous with the sub-frame period. The voltage-setting circuit 114 may be a D/A converter circuit. With such a configuration, one of the voltages of Vss1 to Vss6 can be selected in synchronization with a sub-frame period in accordance with data included in the inputted digital voltage control signal, and the voltage can be supplied to the selection circuit 107 of the subsequent stage. Note that Vss1<Vss2<Vss3<Vss4<Vss5<Vss6 is satisfied.

In the light emitting device of the present invention, a voltage level supplied to the selection circuit from the voltage-setting circuit may be changed per pixel corresponding to red (R), green (G) or blue (B) in order to keep a balance between the luminance of each color. In such a case, the luminance of the pixel corresponding to each color can be controlled by providing a voltage-setting circuit for each color.

In the light emitting device of the present invention, each driver circuit for controlling the operation of the pixel portion, such as a signal line driver circuit and a scan line driver circuit may be formed over the same substrate as the pixel portion or another substrate. Similarly, the selection circuit group and the voltage-setting circuit may be formed over the same substrate as the pixel portion or another substrate.

Embodiment 1

Description is made below with reference to FIG. 6 on a specific configuration example of a signal line driver circuit and a scan line driver circuit included in the light emitting device of the present invention.

Figure 6:
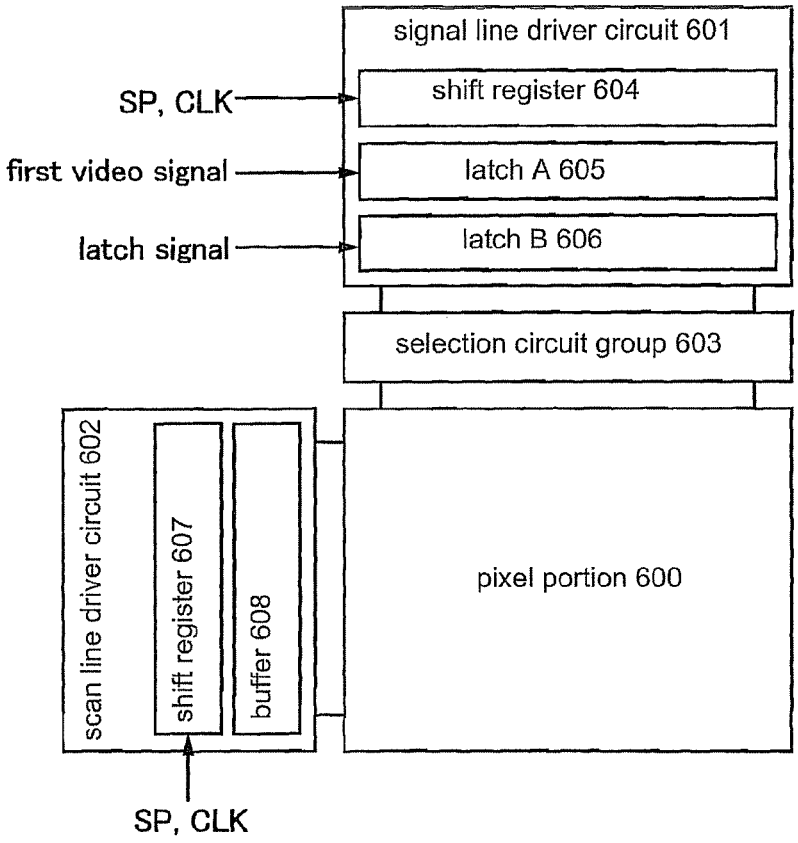
FIG. 6 is a diagram illustrating a specific configuration example of a signal line driver circuit and a scan line driver circuit included in a light emitting device of the present invention.

FIG. 6 is a block diagram illustrating a configuration of a signal line driver circuit 601 and a scan line driver circuit 602 included in the light emitting device of the present embodiment. In FIG. 6, the signal line driver circuit 601 includes a shift register 604, a latch A605 and a latch B606. Various control signals such as a clock signal (CLK) and a start pulse signal (SP) are inputted to the shift register 604. Upon input of the clock signal (CLK) and the start pulse signal (SP), timing signals are generated in the shift register 604. The generated timing signals are sequentially inputted to the latch A605 of the first stage. Upon input of the timing signals to the latch A605, first video signals are sequentially written to and stored in the latch A605 in synchronization with pulses of the timing signals. Note that although the first video signals are sequentially written to the latch A605 in this embodiment, the present invention is not limited to such a configuration. Such configuration is also possible that a plurality of stages of the latch A605 are divided into several groups, and first video signals are inputted to each group in parallel, namely a division drive may be performed. Note that the number of the groups divided is called a division number. When the latch is divided into four groups per several stages, a division drive is performed with four groups divided.

The period through which the first video signals are written to all the stages of the latch A605 is called a row selection period. The actual row selection period may include the aforementioned row selection period and a horizontal retrace period.

Upon completion of one row selection period, a latch signal corresponding to one of the control signals is supplied to the latch B606 of the second stage, thereby the first video signals that are stored in the latch A605 are written to the latch B606 all at once in synchronization with the latch signal. To the latch A605 that has transmitted the first video signals to the latch B606, first video signals of the next bit are sequentially written in synchronization with timing signals from the shift register 604. During the second row selection period, the first video signal written and stored in the latch B606 is inputted to a selection circuit group 603. Accordingly, a second video signal generated in the selection circuit group 603 upon input of the first video signal is inputted to the pixel portion 600.

Note that other circuits such as a decoder capable of selecting signal lines may be employed instead of the shift register 604.

Description is made below on the configuration of the scan line driver circuit 602. The scan line driver circuit 602 includes a shift register 607 and a buffer 608. It may include a level shifter if necessary. In the scan line driver circuit 602, a selection signal is generated in the shift register 607 upon input of a clock signal CLK and a start pulse signal SP thereto. The generated selection signal is buffered/amplified through the buffer 608, and supplied to a corresponding scan line. Operation of transistors included in the pixels in one row is controlled with a selection signal supplied to each scan line, therefore, the buffer 608 is desirably the one capable of supplying a relatively large current to the scan line.

Note that other circuits such as a decoder capable of selecting signal lines may be used instead of the shift register 607.

A panel included in the light emitting device of the present invention is not limited to the configuration shown in FIG. 6. The panel is only required to have a configuration with which gray scales of pixels can be controlled in accordance with the first video signal.

This embodiment can be appropriately implemented in combination with the aforementioned embodiment mode.

Embodiment 2

Description is made below with reference to FIG. 7 on a circuit diagram of a pixel included in a pixel of the light emitting device of the present invention.

Figure 7:
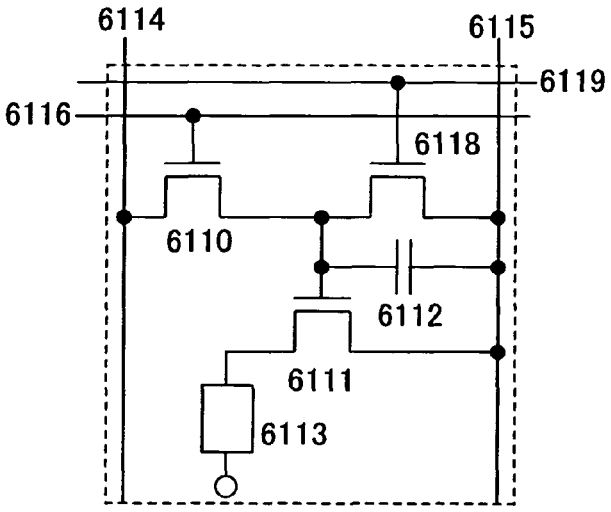
FIG. 7 is an exemplary circuit diagram of a pixel included in a light emitting device of the present invention.

FIG. 7 illustrates an exemplary equivalent circuit diagram of a pixel, which includes a signal line 6114, a power source line 6115, scan lines 6116 and 6119, a light emitting element 6113, TFTs 6110, 6111 and 6118, and a capacitor 6112.

A second video signal is inputted to the signal line 6114 by a signal line driver circuit. The TFT 6110 can control a potential supply of the video signal to a gate of the TFT 6111 in accordance with a selection signal inputted to the scan line 6116. The TFT 6111 can control a current supply to the light emitting element 6113 in accordance with the potential of the video signal. Switching of the TFT 6118 can be controlled with a selection signal inputted to the scan line 6119. The TFT 6118 can forcibly bring the light emitting element 6113 to receive no current, therefore, length of the sub-frame period can be set shorter than the period in which the second video signal is inputted to the whole pixels. Accordingly, high-level gray scales can be displayed with the suppressed drive frequency.

In addition, the capacitor 6112 can hold a gate voltage of the TFT 6111. Note that although FIG. 7 illustrates the capacitor 6112, it may be omitted if the gate capacitance of the TFT 6111 or other parasitic capacitance may be utilized as a capacitor.

Note also that the pixel included in the light emitting device of the present invention is not limited to the configuration shown in this embodiment. This embodiment can be appropriately implemented in combination with the aforementioned embodiment mode or embodiment.

Embodiment 3

Figure 8A:
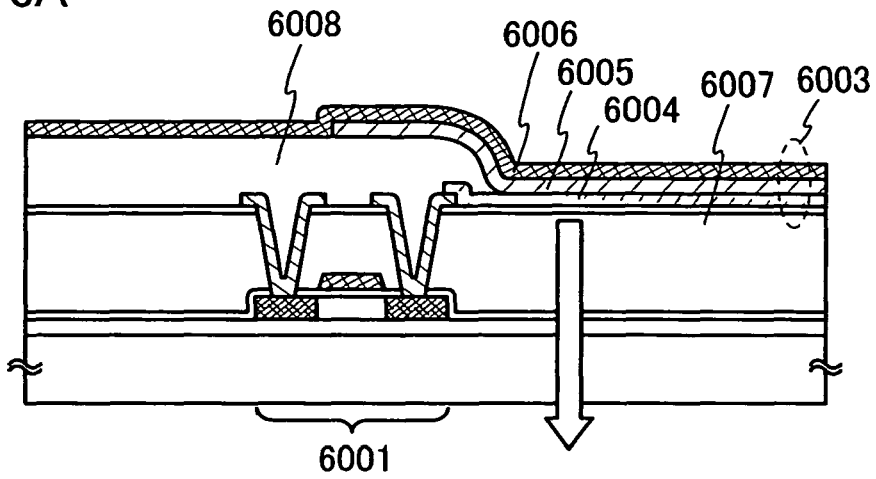
FIGS. 8A to 8C are diagrams each illustrating a cross-sectional structure of a pixel included in a light emitting device of the present invention.
Figure 8B:
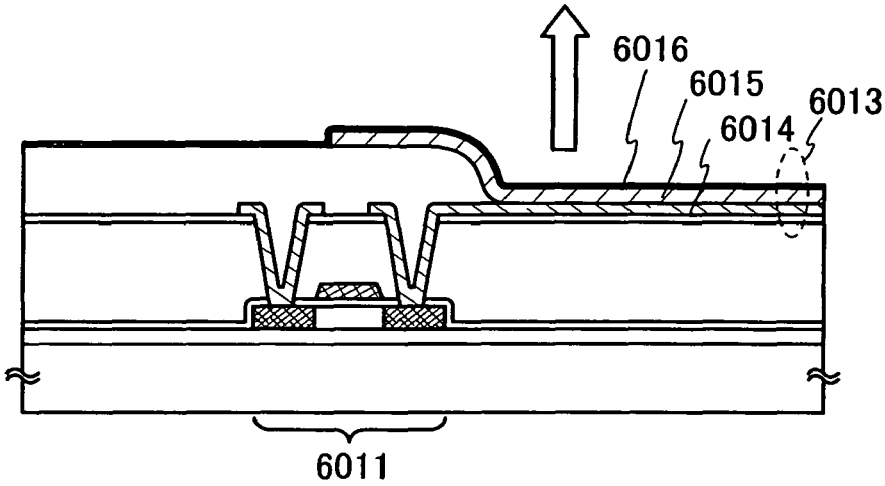
Figure 8C:
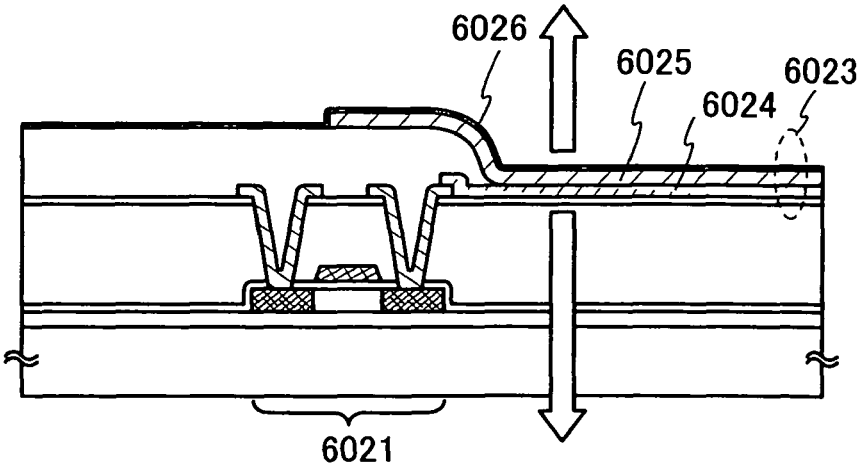

In this embodiment, description is made with reference to FIGS. 8A to 8C on a cross-sectional structure of a pixel in the case where a transistor for controlling a current supply to a light emitting element is a P-channel transistor. Note that in this specification, one of the two electrodes (anode and cathode) of a light emitting element, a potential of which can be controlled with a transistor, is called a first electrode while the other is called a second electrode. FIG. 8 illustrates the case where the first electrode is an anode while the second electrode is a cathode, however, opposite structure may be employed such that the first electrode is a cathode while the second electrode is an anode.

FIG. 8A illustrates a cross-sectional diagram of a pixel in the case where a P-channel transistor 6001 is employed, and light emitted from a light emitting element 6003 is extracted from a first electrode 6004. In FIG. 8A, the first electrode 6004 of the light emitting element 6003 is electrically connected to the transistor 6001.

The transistor 6001 is covered with an interlayer insulating film 6007, and a bank 6008 having an opening is formed over the interlayer insulating film 6007. The first electrode 6004 is partially exposed in the opening of the bank 6008. In the opening, the first electrode 6004, an electroluminescent layer 6005 and a second electrode 6006 are sequentially stacked.

The interlayer insulating film 6007 may be formed by using an organic resin film, an inorganic insulating film or an insulating film having a Si—O—SI bond that is formed of a siloxane-based material as a starting material (hereinafter referred to as a siloxane insulating film). The siloxane insulating film may include an organic group containing at least hydrogen (such as an alkyl group and an aromatic hydrocarbon) as a substituent. Alternatively, a fluoro group may be used as the substituent, or a fluoro group and an organic group containing at least hydrogen may be used as the substituent as well. Alternatively, the interlayer insulating film 6007 may be formed by using a material called a low dielectric constant material (low-k material).

The bank 6008 may be formed by using an organic resin, an inorganic insulating film or a siloxane insulating film. When using the organic resin film, acrylic, polyimide, polyamide and the like may be employed. When using the inorganic insulating film, on the other hand, silicon oxide, silicon nitride oxide and the like may be employed. In particular, when the bank 6008 is formed by using a photosensitive organic resin film to have an opening on the first electrode 6004, and a sidewall of the opening is formed to have an inclined surface with a continuous curvature radius, it can be prevented that the first electrode 6004 is short-circuited to the second electrode 6006.

The first electrode 6004 is formed of a material or with a thickness to transmit light, which is also suitable for being used as an anode. For example, the first electrode 6004 may be formed of indium tin oxide (ITO), zinc oxide (ZnO), indium zinc oxide (IZO), gallium-doped zinc oxide (GZO), or other light transmitting conductive oxides. Alternatively, the first electrode 6004 may be formed of a mixture of ITO, indium tin oxide containing silicon oxide (hereinafter referred to as ITSO) or indium oxide containing silicon oxide with zinc oxide (ZnO) of 2 to 20 wt. %. Further, in addition to the aforementioned light transmitting conductive oxides, the first electrode 6004 may be formed of, for example, a single-layer film of one or more of TiN, ZrN, Ti, W, Ni, Pt, Cr, Ag, Al films and the like, a stacked-layer structure of a titanium nitride film and a film containing aluminum as a main component, or a three-layer structure of a titanium nitride film, a film containing aluminum as a main component and a titanium nitride film. However, when adopting a material other than the light transmitting conductive oxides, the first electrode 6004 is formed thick enough to transmit light (preferably about 5 to 30 nm).

The second electrode 6006 is formed of a material or with a thickness to reflect or shield light. For example, metals, alloys, electrically conductive compounds or mixture of them each having a low work function can be used. Specifically, alkaline metals such as Li and Cs, alkaline earth metals such as Mg, Ca and Sr, alloys containing such metals (Mg:Ag, Al:Li, Mg:In or the like), compounds of such metals ($CaF_2$ or CaN), or rare-earth metals such as Yb and Er can be employed. When providing an electron injection layer, other conductive layers such as an Al layer can be employed as well.

The electroluminescent layer 6005 is formed to have a single or a plurality of layers. In the case of adopting a plurality of layers, these layers may be classified into a hole injection layer, a hole transporting layer, a light emitting layer, an electron transporting layer, an electron injection layer and the like in terms of the carrier transporting properties. When the electroluminescent layer 6005 has, in addition to the light emitting layer, any of the hole injection layer, the hole transporting layer, the electron transporting layer and the electron injection layer, the hole injection layer, the hole transporting layer, the light emitting layer, the electron transporting layer and the electron injection layer are stacked in this order on the first electrode 6004. Note that the boundary of each layer is not necessarily distinct, and the boundary cannot be distinguished clearly in some cases since the materials forming the respective layers are partially mixed into the adjacent layers. Each of the layers may be formed of an organic material or an inorganic material. As for the organic material, any of the high, medium and low molecular weight materials can be employed. Note that the medium molecular weight material means a low polymer in which the number of repeated structural units (the degree of polymerization) is about 2 to 20. There is no clear distinction between the hole injection layer and the hole transporting layer, and both of them inevitably have a hole transporting property (hole mobility). The hole injection layer is in contact with the anode, and a layer in contact with the hole injection layer is distinguished as a hole transporting layer for convenience. The same applies to the electron transporting layer and the electron injection layer. A layer in contact with the cathode is called an electron injection layer while a layer in contact with the electron injection layer is called an electron transporting layer. In some cases, the light emitting layer may combine the function of the electron transporting layer, and it is therefore called a light emitting electron transporting layer.

In the case of the pixel shown in FIG. 8A, light emitted from the light emitting element 6003 can be extracted from the first electrode 6004 as shown by a hollow arrow.

FIG. 8B illustrates a cross-sectional diagram of a pixel in the case where a P-channel transistor 6011 is employed, and light emitted from a light emitting element 6013 is extracted from a second electrode 6016. FIG. 8B shows the structure in which a first electrode 6014 of the light emitting element 6013 is electrically connected to the transistor 6011. On the first electrode 6014, an electroluminescent layer 6015 and the second electrode 6016 are stacked in this order.

The first electrode 6014 is formed of a material or with a thickness to reflect or shield light, which is also suitable for being used as an anode. For example, the first electrode 6014 may be formed of, a single-layer structure of one or more of TiN, ZrN, Ti, W, Ni, Pt, Cr, Ag, Al films and the like, a stacked-layer structure of a titanium nitride film and a film containing aluminum as a main component, or a three-layer structure of a titanium nitride film, a film containing aluminum as a main component and a titanium nitride film.

The second electrode 6016 is formed of a material or with a thickness to transmit light. For example, metals, alloys, electrically conductive compounds or mixture of them each having a low work function can be used. Specifically, alkaline metals such as Li and Cs, alkaline earth metals such as Mg, Ca and Sr, alloys containing such metals (Mg:Ag, Al:Li, Mg:In or the like), compounds of such metals ($CaF_2$ or CaN), or rare-earth metals such as Yb and Er can be employed. When providing an electron injection layer, other conductive layers such as an Al layer may be employed as well. The second electrode 6016 is formed thick enough to transmit light (preferably about 5 to 30 nm). Note that the second electrode 6016 may be formed of indium tin oxide (ITO), zinc oxide (ZnO), indium zinc oxide (IZO), gallium-doped zinc oxide (GZO), or other light transmitting conductive oxides. Alternatively, the second electrode 6016 may be formed of a mixture of ITO, ITSO or indium oxide containing silicon oxide with zinc oxide (ZnO) of 2 to 20%. When adopting such light transmitting conductive oxides, the electroluminescent layer 6015 is preferably provided with an electron injection layer.

The electroluminescent layer 6015 may be formed similarly to the electroluminescent layer 6005 shown in FIG. 8A.

In the case of the pixel shown in FIG. 8B, light emitted from the light emitting element 6013 can be extracted from the second electrode 6016 as shown by a hollow arrow.

FIG. 8C illustrates a cross-sectional diagram of a pixel in the case where a P-channel transistor is employed, and light emitted from a light emitting element 6023 is extracted from both sides of a first electrode 6024 and a second electrode 6026. FIG. 8C illustrates the structure in which the first electrode 6024 of the light emitting element 6023 is electrically connected to the driving transistor 6021. On the first electrode 6024, an electroluminescent layer 6025 and a second electrode 6026 are stacked in this order.

The first electrode 6024 may be formed similarly to the first electrode 6004 shown in FIG. 8A. The second electrode 6026 may be formed similarly to the second electrode 6016 shown in FIG. 8B. In addition, the electroluminescent layer 6025 may be formed similarly to the electroluminescent layer 6005 shown in FIG. 8A.

In the case of the pixel shown in FIG. 8C, light emitted from the light emitting element 6023 can be extracted from both sides of the first electrode 6024 and the second electrode 6024 as shown by hollow arrows.

This embodiment can be appropriately implemented in combination with the aforementioned embodiment mode or embodiments.

Embodiment 4

Figure 9A:
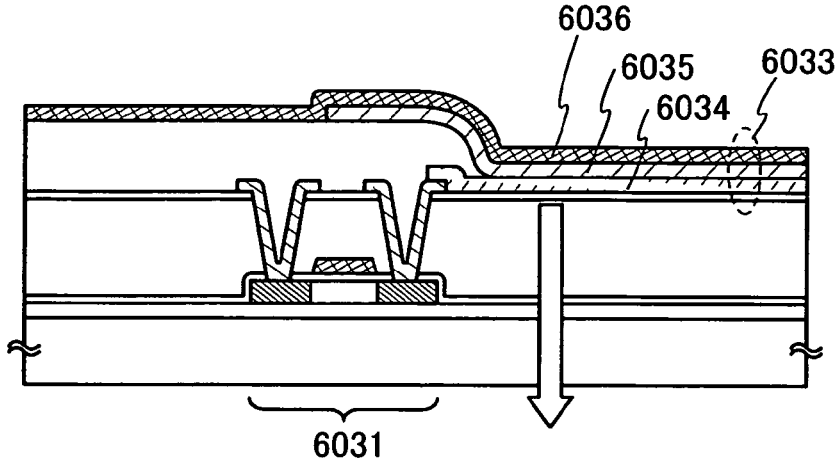
FIGS. 9A to 9C are diagrams each illustrating a cross-sectional structure of a pixel included in a light emitting device of the present invention.
Figure 9B:
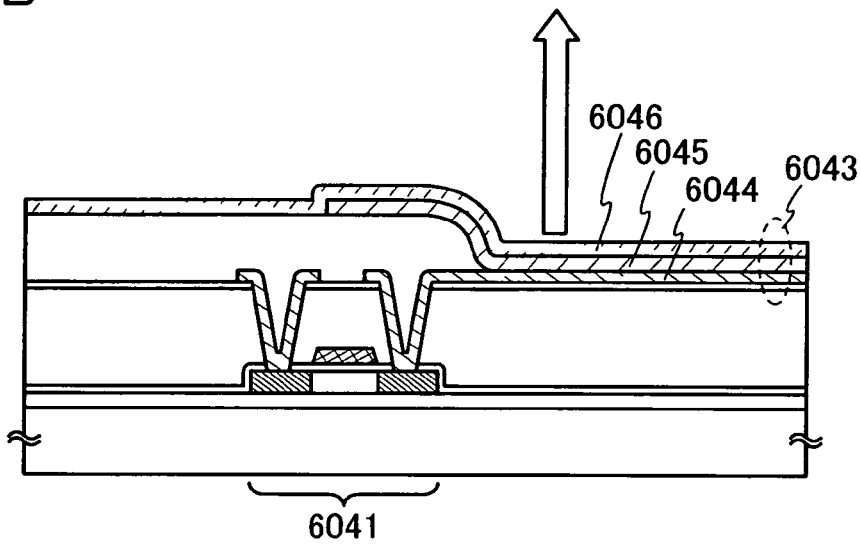
Figure 9C:
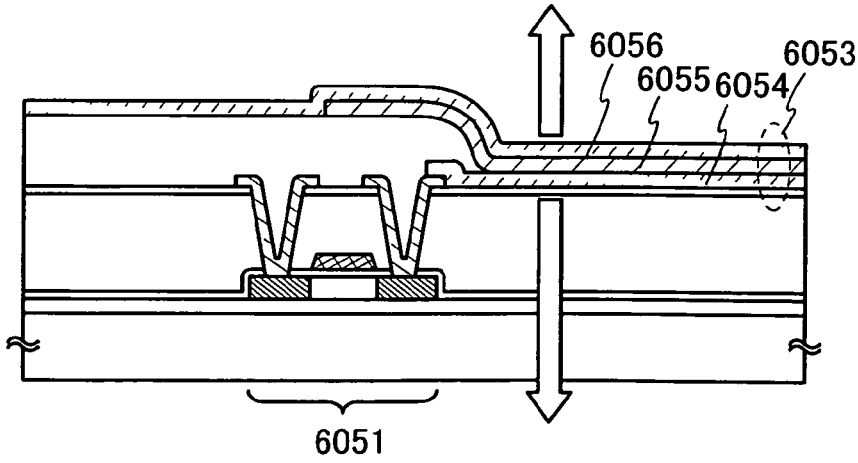

In this embodiment, description is made with reference to FIGS. 9A to 9C on the cross-sectional structure of a pixel in the case where an N-channel transistor is employed. Although FIGS. 9A to 9C each illustrates the case where the first electrode is a cathode while the second electrode is an anode, opposite structure may be employed such that the first electrode is an anode while the second electrode is a cathode.

FIG. 9A illustrates a cross-sectional diagram of a pixel in the case where an N-channel transistor is employed, and light emitted from a light emitting element 6033 is extracted from a first electrode 6034. In FIG. 9A, the first electrode 6034 of the light emitting element 6033 is electrically connected to the transistor 6031. On the first electrode 6034, an electroluminescent layer 6035 and a second electrode 6036 are stacked in this order.

The first electrode 6034 is formed of a material or with a thickness to transmit light. For example, metals, alloys, electrically conductive compounds or mixture of them each having a low work function may be used. Specifically, alkaline metals such as Li and Cs, alkaline earth metals such as Mg, Ca and Sr, alloys containing such metals (Mg:Ag, Al:Li, Mg:In or the like), compounds of such metals ($CaF_2$ or CaN), or rare-earth metals such as Yb and Er can be employed. When providing an electron injection layer, other conductive layers such as an Al layer can be employed as well. In such a case, the second electrode 6034 is formed thick enough to transmit light (preferably about 5 to 30 nm), and a light transmitting conductive layer may be formed by using a light transmitting conductive oxide so as to be in contact with the top or bottom surface of the aforementioned conductive layer having a thickness to transmit light, thereby suppressing sheet resistance of the first electrode 6034. Note that the first electrode 6034 may also be formed of indium tin oxide (ITO), zinc oxide (ZnO), indium zinc oxide (IZO), gallium-doped zinc oxide (GZO), or other light transmitting conductive oxides. Alternatively, the first electrode 6034 may be formed of a mixture of ITO, ITSO or indium oxide containing silicon oxide with zinc oxide (ZnO) of 2 to 20 wt. %. When adopting such light transmitting conductive oxides, the electroluminescent layer 6035 is preferably provided with an electron injection layer.

The second electrode 6036 is formed of a material or with a thickness to reflect or shield light, which is also suitable for being used as an anode. For example, the second electrode 6036 may be formed of a single-layer structure of one or more of TiN, ZrN, Ti, W, Ni, Pt, Cr, Ag, Al films and the like, a stacked-layer structure of a titanium nitride film and a film containing aluminum as a main component, or a three-layer structure of a titanium nitride film, a film containing aluminum as a main component and a titanium nitride film.

The electroluminescent layer 6035 may be formed similarly to the electroluminescent layer 6005 shown in FIG. 8A. However, when the electroluminescent layer 6035 has, in addition to the light emitting layer, any of a hole injection layer, a hole transporting layer, an electron transporting layer and an electron injection layer, the electron injection layer, the electron transporting layer, the light emitting layer, the hole transporting layer and the hole injection layer are stacked in this order on the first electrode 6034.

In the pixel shown in FIG. 9A, light emitted from the light emitting element 6033 can be extracted from the first electrode 6034 as shown by a hollow arrow.

FIG. 9B illustrates a cross-sectional diagram of a pixel in the case where an N-channel transistor 6041 is employed, and light emitted from a light emitting element 6043 is extracted from a second electrode 6046 side. In FIG. 9B, a first electrode 6044 of the light emitting element 6043 is electrically connected to the transistor 6041. On the first electrode, 6044, an electroluminescent layer 6045 and the second electrode 6046 are stacked in this order.

The first electrode 6044 is formed of a material or with a thickness to reflect or shield light. For example, metals, alloys, electrically conductive compounds or mixture of them each having a low work function can be used. Specifically, alkaline metals such as Li and Cs, alkaline earth metals such as Mg, Ca and Sr, alloys containing such metals (Mg:Ag, Al:Li, Mg:In or the like), compounds of such metals ($CaF_2$ or CaN), or rare-earth metals such as Yb and Er can be employed. When providing an electron injection layer, other conductive layers such as an Al layer may be employed as well.

The second electrode 6046 is formed of a material or with a thickness to transmit light, which is also suitable for being used as an anode. For example, the second electrode 6046 may be formed of indium tin oxide (ITO), zinc oxide (ZnO), indium zinc oxide (IZO), gallium-doped zinc oxide (GZO), or other light transmitting conductive oxides. Alternatively, the second electrode 6046 may be formed of a mixture of ITO, ITSO or indium oxide containing silicon oxide with zinc oxide (ZnO) of 2 to 20 wt. %. Further, in addition to the aforementioned light transmitting oxides, the second electrode 6046 may be formed of, for example, a single-layer structure of one or more of TiN, ZrN, Ti, W, Ni, Pt, Cr, Ag, Al films and the like, a stacked-layer structure of a titanium nitride film and a film containing aluminum as a main component, or a three-layer structure of a titanium nitride film, a film containing aluminum as a main component and a titanium nitride film. However, when adopting a material other than the light transmitting conductive oxides, the second electrode 6046 is formed thick enough to transmit light (preferably about 5 to 30 nm).

The electroluminescent layer 6045 may be formed similarly to the electroluminescent layer 6035 shown in FIG. 9A.

In the case of the pixel shown in FIG. 9B, light emitted from the light emitting element 6043 can be extracted from the second electrode 6046 side as shown by a hollow arrow.

FIG. 9C illustrates a cross-sectional diagram of a pixel in the case where an N-channel transistor 6051 is employed, and light emitted from a light emitting element is 6053 is extracted from both sides of a first electrode 6054 and a second electrode 6056. In FIG. 9C, the first electrode 6054 of the light emitting element 6053 is electrically connected to the transistor 6051. On the first electrode 6054, an electroluminescent layer 6055 and a second electrode 6056 are stacked in this order.

The first electrode 6054 may be formed similarly to the first electrode 6034 shown in FIG. 9A. The second electrode 6056 may be formed similarly to the second electrode 6046 shown in FIG. 9B. In addition, the electroluminescent layer 6055 may be formed similarly to the electroluminescent layer 6035 shown in FIG. 9A.

In the case of the pixel shown in FIG. 9C, light emitted from the light emitting element 6053 can be extracted from both sides of the first electrode 6054 and the second electrode 6056 as shown by hollow arrows.

This embodiment can be appropriately implemented in combination with the aforementioned embodiment mode or embodiments.

Embodiment 5

The light emitting device of the present invention can be formed by using a printing method typified by screen printing and offset printing, or a droplet discharge method. The droplet discharge method is a method for forming a predetermined pattern by discharging droplets containing a predetermined composition from an orifice, which includes an ink-jet printing method. When using such printing method or droplet discharge method, various wirings typified by signal lines, scan lines, selection lines, a gate electrode of a TFT or an electrode of a light emitting element and the like can be formed. However, the printing method or the droplet discharge method is not necessarily used for the whole steps of forming patterns. Accordingly, such process is possible that wirings and a gate electrode are formed by the printing method or the droplet discharge method while a semiconductor film is patterned by lithography, in which case the printing method or the droplet discharge method is used at least for a part of the steps, and lithography is combined. Further, a mask used for patterning may be formed by the printing method or the droplet discharge method as well.

Figure 10:
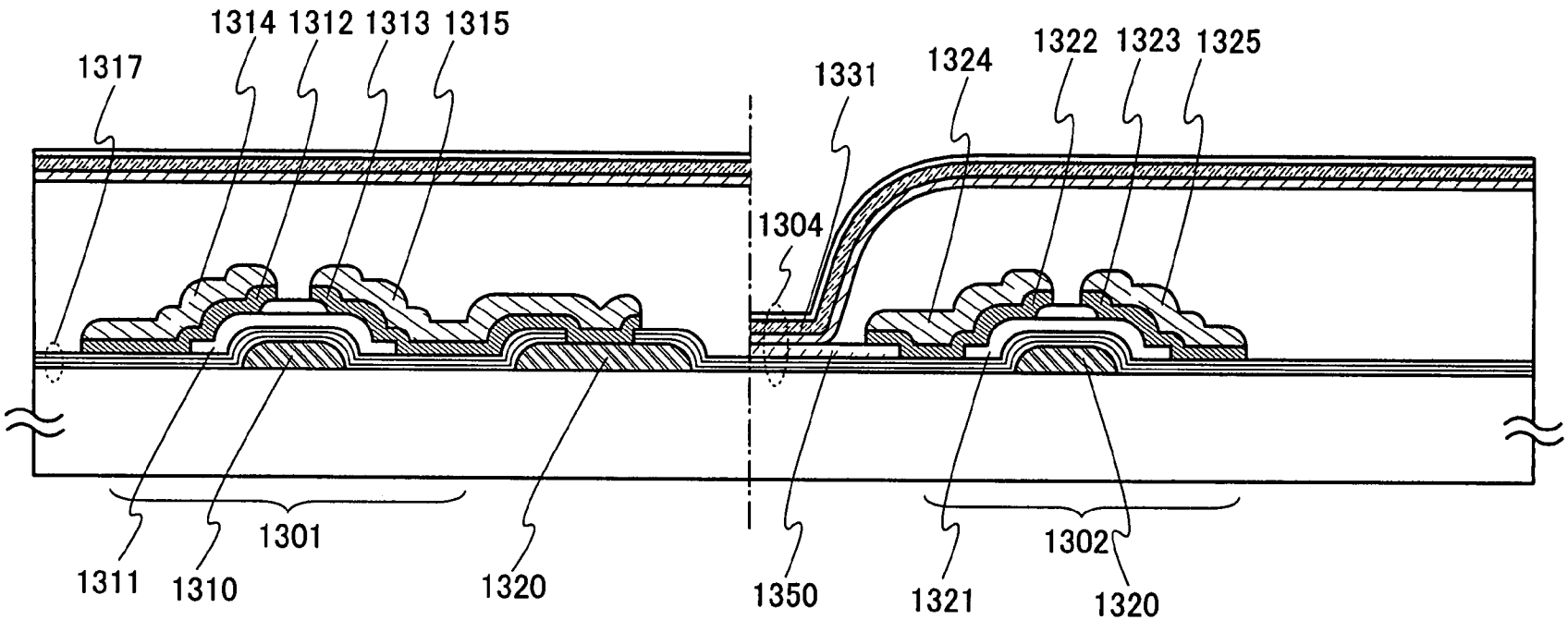
FIG. 10 is a diagram illustrating a cross-sectional structure of a pixel included in a light emitting device of the present invention.

FIG. 10 illustrates an exemplary cross-sectional diagram of the light emitting device of the present invention formed by using the droplet discharge method. In FIG. 10, reference numerals 1301 and 1302 denote transistors and 1304 denotes a light emitting element. The transistor 1302 is electrically connected to a first electrode 1350 of the light emitting element 1304. The driving transistor 1302 is desirably an N-channel transistor, in which case it is desirable that the first electrode 1350 be a cathode while a second electrode 1331 be an anode.

The transistor 1301 functioning as a switching element comprises a gate 1310, a first semiconductor film 1311 including a channel formation region, a gate insulating film 1317 formed between the gate 1310 and the first semiconductor film 1311, second semiconductor films 1312 and 1313 functioning as a source or a drain, a wiring 1314 connected to the second semiconductor film 1312, and a wiring 1315 connected to the second semiconductor film 1313.

The transistor 1302 comprises a gate 1320, a first semiconductor film 1321 including a channel formation region, the gate insulating film 1317 formed between the gate 1320 and the first semiconductor film 1321, second semiconductor films 1322 and 1323 functioning as a source or a drain, a wiring 1324 connected to the second semiconductor film 1322, and a wiring 1325 connected to the second semiconductor film 1323.

The wiring 1314 corresponds to a signal line, and the wiring 1315 is electrically connected to the gate 1320 of the transistor 1302. The wiring 1325 corresponds to the power supply line.

By forming patterns using the droplet discharge method or the printing method, a series of steps such as lithography steps including photoresist coating, exposure and development, an etching step and a peeling step can be simplified. In addition, when adopting the droplet discharge method or the printing method, waste of materials that would otherwise be removed by etching can be avoided unlike the case of adopting lithography. Further, since an expensive mask for exposure is not required, manufacturing cost of the light emitting device can be suppressed.

Further, unlike lithography, etching steps for forming wirings are not required. Accordingly, time required for formation steps of wirings can be significantly reduced as compared to the case of performing lithography. In particular, when the wirings are formed with a thickness of 0.5 μm or more, and more preferably 2 μm or more, wiring resistance can be suppressed, therefore, time required for the manufacturing steps of the wirings can be reduced while suppressing the wiring resistance that tends to be increased along with the enlargement of the light emitting device.

Note that each of the first semiconductor films 1311 and 1321 may be either an amorphous semiconductor or a semi-amorphous semiconductor (SAS).

Amorphous semiconductor can be obtained by decomposing a silicon gas by glow discharge. As the typical silicon gas, $SiH_4$ or $Si_2H_6$ can be employed. The silicon gas may be diluted with hydrogen, or hydrogen and helium.

SAS can also be obtained by decomposing a silicon gas by glow discharge. As the typical silicon gas, $SiH_4$ can be used as well as other silicon gas such as $Si_2H_6$, $SiH_2Cl_2$, $SiHCl_3$, $SiCl_4$ and $SiF_4$. In addition, manufacture of the SAS can be facilitated when the silicon gas is diluted with a mixed gas of hydrogen and a noble-gas element selected from one or more of helium, argon, krypton and neon. The silicon gas is preferably diluted to a ratio of 2 to 1000 times. Further, the silicon gas may be mixed with a carbon gas such as $CH_4$ and $C_2H_6$, a germanium gas such as $GeH_4$ and $GeF_4$ or $F_2$ while the energy bandwidth may be controlled to be 1.5 to 2.4 eV or 0.9 to 1.1 eV A TFT using an SAS as the first semiconductor layer can obtain the mobility of 1 to 10 $cm^2$/Vsec or more.

In addition, the first semiconductor films 1311 and 1321 may be formed of a semiconductor obtained by irradiating a semi-amorphous semiconductor (SAS) with laser.

This embodiment can be appropriately implemented in combination with the aforementioned embodiment mode or embodiments.

Embodiment 6

Figure 11A:
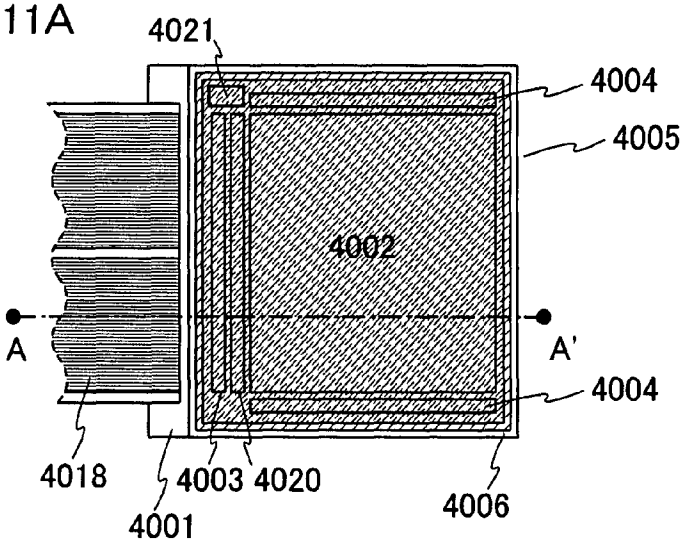
FIG. 11A is a top view of a light emitting device of the present invention.
Figure 11B:
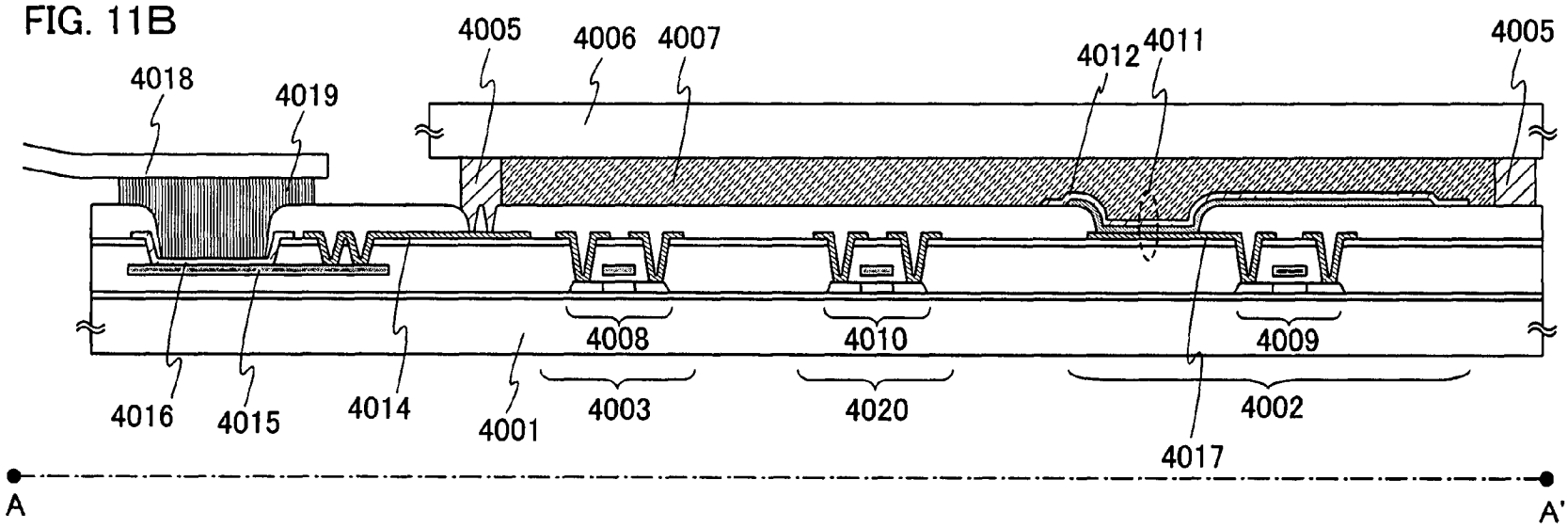
FIG. 11B is a cross-sectional diagram thereof.

In this embodiment, description is made with reference to FIGS. 11A and 11B on the exterior view of a panel that corresponds to one mode of the light emitting device of the present invention. FIG. 11A illustrates a top view of a panel obtained by sealing a first substrate over which transistors and light emitting elements are formed and a second substrate with a sealant. FIG. 11B illustrates a cross-sectional diagram of FIG. 11A along a line A-A'.

A sealant 4005 is provided so as to surround a pixel portion 4002, a signal line driver circuit 4003, a scan line driver circuit 4004, a switching circuit group 4020 and a voltage-setting circuit 4021 formed over a first substrate 4001. In addition, a second substrate 4006 is provided over the pixel portion 4002, the signal line driver circuit 4003, the scan line driver circuit 4004, the switching circuit group 4020 and the voltage-setting circuit 4021. Accordingly, the pixel portion 4002, the signal line driver circuit 4003, the scan line driver circuit 4004, the switching circuit group 4020 and the voltage-setting circuit 4021 are tightly sealed together with a filler 4007 by the first substrate 4001, the sealant 4005 and the second substrate 4006.

Each of the pixel portion 4002, the signal line driver circuit 4003, the scan line driver circuit 4004, the switching circuit group 4020 and the voltage-setting circuit 4021 formed over the first substrate 4001 has a plurality of transistors. FIG. 11B illustrates a transistor 4008 included in the signal line driver circuit 4003, a transistor 4009 included in the pixel portion 4002, and a transistor 4010 included in the switching circuit group 4020.

Reference numeral 4011 corresponds to a light emitting element. A wiring 4017 connected to a drain of the transistor 4009 partially functions as a first electrode of the light emitting element 4011. In addition a light transmitting conductive film 4012 functions as a second electrode of the light emitting element 4011. Note that the structure of the light emitting element 4011 is not limited to the one shown in this embodiment. The structure of the light emitting element 4011 may be appropriately changed in accordance with the direction of light emitted from the light emitting element 4011 and the conductivity of the driving transistor 4009.

Various signals and voltages supplied to the signal line driver circuit 4003, the scan line driver circuit 4004, the pixel portion 4002, the switching circuit group 4020 or the voltage-setting circuit 4021 are not shown in the cross-sectional diagram in FIG. 14B, however, they are supplied from a connecting terminal 4016 through lead wirings 4014 and 4015.

In this embodiment, the connecting terminal 4016 is formed of the same conductive film as the first electrode of the light emitting element 4011. The lead wiring 4014 is formed of the same conductive film as the wiring 4017. The lead wiring 4015 is formed of the same conductive film as the respective gates of the driving transistor 4009 and the transistor 4008.

The connecting terminal 4016 is electrically connected to a terminal of an FPC 4018 through an anisotropic conductive film 4019.

Note that each of the first substrate 4001 and the second substrate 4006 may be formed of glass, metal (typically, stainless), ceramics, plastic and the like. As for the plastic, an FRP (Fiberglass-Reinforced Plastics) substrate, a PVF (Polyvinylfluoride) film, a mylar film, a polyester film or an acrylic resin film may be employed. In addition, a sheet having a structure that aluminum is sandwiched by a PVF film and a mylar film can be employed.

Note that the second substrate 4006, which is disposed on the side from which light emitted from the light emitting element 4011 is extracted, is required to transmit light. In this case, the second substrate 4006 is formed of a light transmitting material such as a glass substrate, a plastic substrate, a polyester film and an acrylic film.

As for the filler 4007, inert gas such as a nitrogen gas and an argon gas, an ultraviolet curable resin or a heat curable resin can be used such as PVC (polyvinyl chloride), acrylic, polyimide, an epoxy resin, a silicone resin, PVB (polyvinyl butyral) and EVA (ethylene vinyl acetate). In this embodiment, a nitrogen gas is employed as the filler.

This embodiment can be appropriately implemented in combination with the aforementioned embodiment mode or embodiments.

Embodiment 7

Since the light emitting device of the present invention can suppress generation of pseudo-contours, it can be suitably applied to an electronic appliance having a display portion for image display such as a display device and a goggle display.

Further, the light emitting device of the present invention can be applied to various electronic appliances such as a video camera, a digital camera, a goggle display (e.g., head mounted display), a navigation system, a sound reproducing device (e.g., car audio and component stereo set), a laptop computer, a game machine, a portable information terminal (e.g., mobile computer, portable phone, portable game machine and electronic book), and an image reproducing device equipped with a recording medium (typically, a device reproducing a recording medium such as a DVD: Digital Versatile Disk, and having a display for displaying the reproduced image). Specific examples of such electronic appliances are shown in FIGS. 12A to 12C.

Figure 12A:
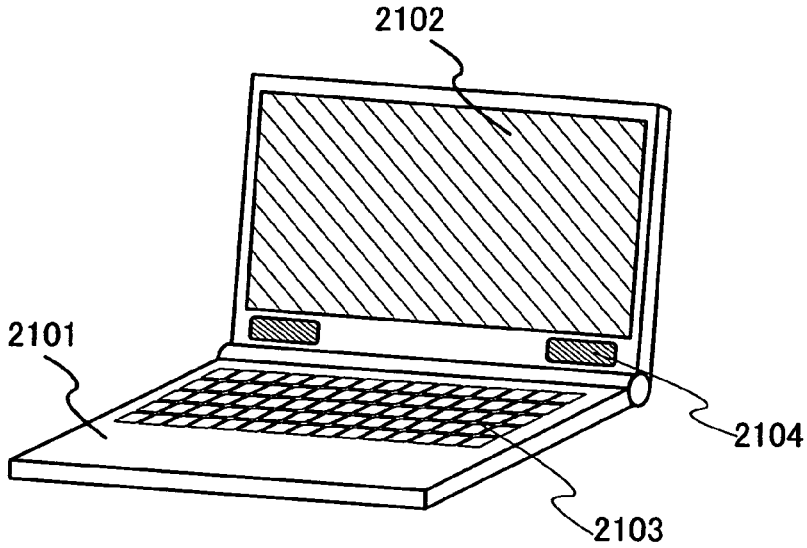
FIGS. 12A to 12C are views of electronic appliances to which the light emitting device of the present invention is applied.

FIG. 12A illustrates a laptop computer that includes a main body 2101, a display portion 2102, an operating key 2103, a speaker portion 2104 and the like. The light emitting device of the present invention can be applied to the display portion 2102.

Figure 12B:
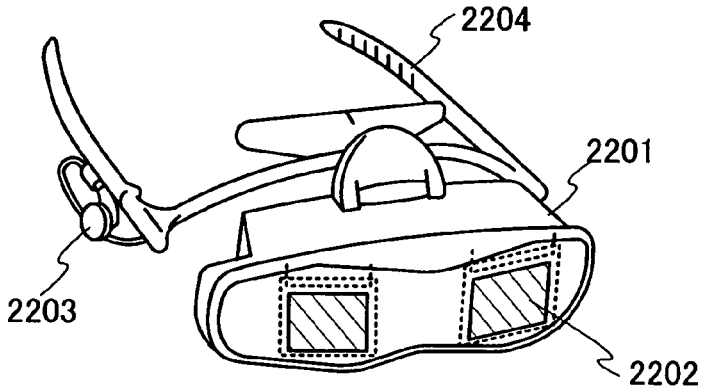

FIG. 12B illustrates a goggle display device that includes a main body 2201, a display portion 2202, an earphone 2203, a supporting portion 2204 and the like. The light emitting device of the present invention can be applied to the display portion 2202. The supporting portion 2204 may be of a type for fixing the goggle display device on the user's head or a type for fixing it on the user's body other than the head.

Figure 12C:
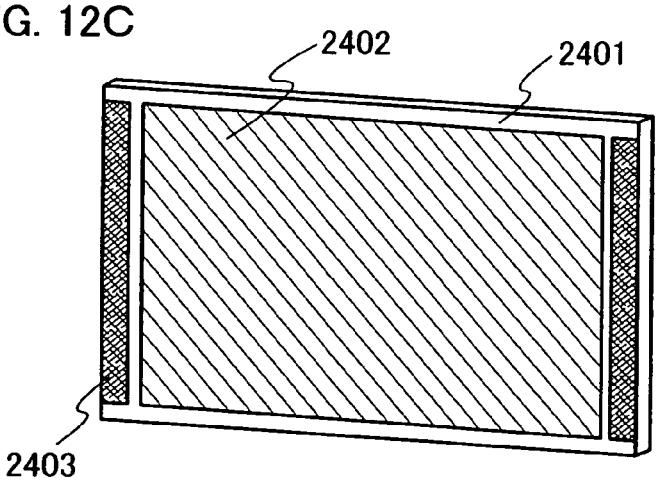

FIG. 12C illustrates a display device that includes a housing 2401, a display portion 2402, a speaker portion 2403 and the like. The light emitting device of the present invention can be applied to the display portion 2402. Since the light emitting device is of a self-luminous type, no backlight is required, and a thinner display portion can be provided as compared to liquid crystal displays. Note that the display device includes all information display devices for personal computer, for TV broadcast reception, for advertisement display and the like. In the case of adopting the light emitting device for the display device, a polarizing plate is desirably provided in order to prevent that images are displayed like mirror images due to the external light reflected on the first electrode or the second electrode.

As set forth above, the application range of the present invention is so wide that it can be applied to electronic devices of various fields. In addition, this embodiment can be appropriately implemented in combination with the aforementioned embodiment mode or embodiments.

The present application is based on Japanese Priority application No. 2004-151134 filed on May 21, 2004 with the Japanese Patent Office, the entire contents of which are hereby incorporated by reference.

What is claimed is:

1. A light emitting device comprising:

a pixel portion comprising a plurality of pixels at intersections of a signal line and a plurality of scan lines, each of the plurality of pixels comprising a light emitting element;

a signal line driver circuit configured to output sequentially first to N-th bits of a first video signal, wherein N is an natural number greater than 1; a voltage-setting circuit configured to select a first voltage from a plurality of voltages in accordance with one of the first to N-th sub-frame periods, and to output the first voltage, wherein the first to N-th sub-frame periods correspond to the first to Nth bits of the first video signal, respectively, and wherein one frame period comprises the first to N-th sub-frame periods; a selection circuit comprising an inverter, in which the first video signal, the first voltage and a second voltage are inputted; wherein the selection circuit outputs the first voltage or the second voltage as a second video signal to one of the plurality of pixels through the signal line, wherein the second voltage has a constant level wherein values of the first voltages corresponding to the first to N-th sub-frame periods are different from each other, and wherein all of the first to N-th sub-frame periods have a same length.

2. A light emitting device according to claim 1, wherein the light emitting device is incorporated into an electronic appliance selected from a group consisting of a video camera, a digital camera, a goggle display a navigation system, a sound reproducing device a laptop computer, a game machine, a portable information terminal, a mobile computer, a portable phone, a portable game machine, an electronic book, an image reproducing device, and a display device.

3. A light emitting device comprising: a pixel portion comprising a plurality of pixels at intersections of a signal line and a plurality of scan lines, each of the plurality of pixels comprising a light emitting element; a signal line driver circuit configured to output sequentially first to N-th bits of a first video signal, wherein N is an natural number greater than 1; a voltage-setting circuit configured to select a first voltage from a plurality of voltages in accordance with one of the first to N-th sub-frame periods, and to output the first voltage; and a selection circuit comprising a transmission gate, in which the first video signal, the first voltage and a second voltage are inputted, wherein the first to N-th sub-frame periods correspond to the first to Nth bits of the first video signal, respectively, and wherein one frame period comprises the first to N-th sub-frame periods; wherein the selection circuit outputs the first voltage or the second voltage as a second video signal to one of the plurality of pixels through the signal line, wherein the second voltage has a constant level wherein values of the first voltages corresponding to the first to N-th sub-frame periods are different from each other, and wherein all of the first to N-th sub-frame periods have a same length.

4. A light emitting device according to claim 3, wherein the light emitting device is incorporated into an electronic appliance selected from a group consisting of a video camera, a digital camera, a goggle display a navigation system, a sound reproducing device a laptop computer, a game machine, a portable information terminal, a mobile computer, a portable phone, a portable game machine, an electronic book, an image reproducing device, and a display device.

5. A light emitting device comprising: a pixel portion comprising a plurality of pixels at intersections of a signal line and a plurality of scan lines, each of the plurality of pixels comprising a light emitting element and a transistor for controlling a current supply to the light emitting element;

a signal line driver circuit configured to output sequentially first to N-th bits of a first video signal, wherein N is an natural number greater than 1; a voltage-setting circuit configured to select a first voltage from a plurality of voltages in accordance with one of the first to N-th sub-frame periods, and to output the first voltage, wherein the first to N-th sub-frame periods correspond to the first to Nth bits of the first video signal, respectively, and wherein one frame period comprises the first to N-th sub-frame periods; a selection circuit comprising an inverter, in which the first video signal, the first voltage and a second voltage are inputted; wherein the selection circuit outputs the first voltage or the second voltage as a second video signal to one of the plurality of pixels through the signal line, wherein the second voltage has a constant level, wherein a gate voltage of the transistor is controlled with the second video signal wherein values of the first voltages corresponding to the first to N-th sub-frame periods are different from each other, and wherein all of the first to N-th sub-frame periods have a same length.

6. The light emitting device according to claim 5, wherein the transistor operates in a saturation region.

7. A light emitting device according to claim 5, wherein the light emitting device is incorporated into an electronic appliance selected from a group consisting of a video camera, a digital camera, a goggle display a navigation system, a sound reproducing device a laptop computer, a game machine, a portable information terminal, a mobile computer, a portable phone, a portable game machine, an electronic book, an image reproducing device, and a display device.

8. A light emitting device comprising:

a pixel portion comprising a plurality of pixels at intersections of a signal line and a plurality of scan lines, each of the plurality of pixels comprising a light emitting element and a transistor for controlling a current supply to the light emitting element;

a signal line driver circuit configured to output sequentially first to N-th bits of a first video signal, N is an natural number greater than 1; a voltage-setting circuit configured to select a first voltage from a plurality of voltages in accordance with one of the first to N-th sub-frame periods, and to output the first voltage, wherein the first to N-th sub-frame periods correspond to the first to Nth bits of the first video signal, respectively, and wherein one frame period comprises the first to N-th sub-frame periods; and a selection circuit comprising a transmission gate, in which the first video signal, the first voltage and a second voltage are inputted; wherein the selection circuit outputs the first voltage or the second voltage as a second video signal to one of the plurality of pixels though the signal line, wherein a gate voltage of the transistor is controlled with the second video signal wherein values of the first voltages corresponding to the first to N-th sub-frame periods are different from each other, and wherein all of the first to N-th sub-frame periods have a same length.

9. The light emitting device according to claim 8, wherein the transistor operates in a saturation region.

10. A light emitting device according to claim 8, wherein the light emitting device is incorporated into an electronic appliance selected from a group consisting of a video camera, a digital camera, a goggle display a navigation system, a sound reproducing device a laptop computer, a game machine, a portable information terminal, a mobile computer, a portable phone, a portable game machine, an electronic book, an image reproducing device, and a display device.

* * * * *

UNITED STATES PATENT AND TRADEMARK OFFICE

CERTIFICATE OF CORRECTION

PATENT NO. : 8,194,009 B2
APPLICATION NO. : 11/132030
DATED : June 5, 2012
INVENTOR(S) : Tomoyuki Iwabuchi It is certified that error appears in the above-identified patent and that said Letters Patent is hereby corrected as shown below:

Column 16, Line 33; Change “transmitting oxides” to --transmitting conductive oxides--.

Column 16, Line 51; Change “element is 6053” to --element 6053--.

Column 22, Line 39, Claim 8; Change “though” to --through--.

Signed and Sealed this
Eleventh Day of September, 2012

David J. Kappos

David J. Kappos
*Director of the United States Patent and Trademark Office*